US008633862B2

(12) United States Patent
Tasaki et al.

(10) Patent No.: US 8,633,862 B2
(45) Date of Patent: Jan. 21, 2014

(54) MOBILE COMMUNICATION BASE STATION ANTENNA

(75) Inventors: Osamu Tasaki, Hitachi (JP); Tomoyuki Ogawa, Hitachi (JP); Takayuki Shimizu, Hitachi (JP); Shinsuke Murano, Kasama (JP); Ryota Suzuki, Tokai-mura (JP)

(73) Assignee: Hitachi Cable, Ltd., Tokyo (JP)

( * ) Notice: Subject to any disclaimer, the term of this patent is extended or adjusted under 35 U.S.C. 154(b) by 302 days.

(21) Appl. No.: 13/232,845

(22) Filed: Sep. 14, 2011

(65) Prior Publication Data

US 2012/0062440 A1 Mar. 15, 2012

(30) Foreign Application Priority Data

Sep. 14, 2010 (JP) ..... 2010-205558

(51) Int. Cl.
*H01Q 21/26* (2006.01)

(52) U.S. Cl.
USPC ..... 343/797; 343/841; 343/893

(58) Field of Classification Search
USPC ..... 343/893, 841, 853, 797
See application file for complete search history.

(56) References Cited

U.S. PATENT DOCUMENTS

2002/0101385 A1* 8/2002 Huor ..... 343/770
2005/0003864 A1* 1/2005 Elliot et al. ..... 455/562.1
2009/0322608 A1* 12/2009 Adams et al. ..... 342/368

FOREIGN PATENT DOCUMENTS

JP 2001-313525 A 11/2011

OTHER PUBLICATIONS

K. Nishimori et al, "Channel Capacity Measurement of 8×2 MIMO Transmission by Antenna Configurations in an Actual Cellular Environment", IEEE Transactions on Antennas and Propagation, vol. 54, No. 11, Nov. 2006, pp. 3285-3291.

* cited by examiner

*Primary Examiner* — Hoanganh Le
(74) *Attorney, Agent, or Firm* — McGinn IP Law Group, PLLC

(57) ABSTRACT

A mobile communication base station antenna has a first array antenna and a second array antenna. Antenna elements of the first and second array antennas are classified into the first, second and third groups G1, G2 and G3. A first feeding port is connected to the antenna elements in the odd number groups (the first group G1 and the third group G3) of the first array antenna and the antenna elements in the even number group of the second array antenna. On the other hand, a second feeding port is connected to the antenna elements in the even number group (the second group G2) of the first array antenna and the antenna elements in the odd number groups (the first group G1 and the third group G3) of the second array antenna.

16 Claims, 26 Drawing Sheets

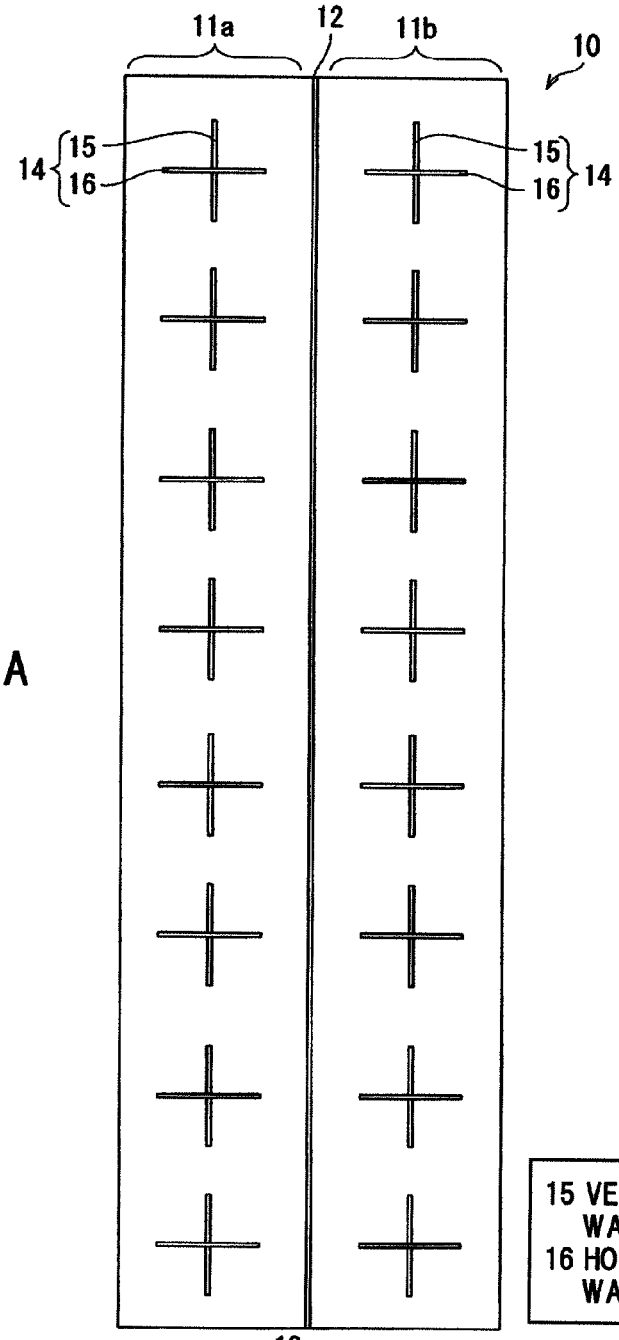
FIG.2A
FIG.2C
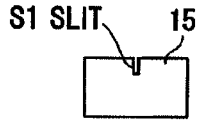
FIG.2D
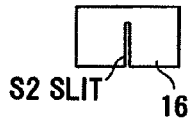
15 VERTICAL POLARIZED WAVE ANTENNA ELEMENT
16 HORIZONTAL POLARIZED WAVE ANTENNA ELEMENT
FIG.2B
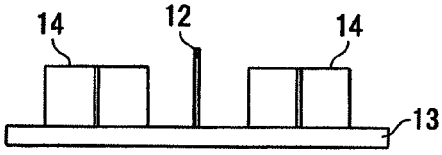

MOBILE COMMUNICATION BASE STATION ANTENNA

The present application is based on Japanese Patent Application No. 2010-205558 filed on Sep. 14, 2010, the entire contents of which are incorporated herein by reference.

BACKGROUND OF THE INVENTION

1. Field of the Invention

The present invention relates to a mobile communication base station antenna, in which simultaneous connection of plural users can be realized.

2. Related Art

Technique such as Frequency Division Multiple Access (FDMA), Time Division Multiple Access (TDMA), or Code Division Multiple Access (CDMA) has been proposed to realize the simultaneous connection of the plural users in a base station to be used for mobile communication, and has been introduced into commercial systems.

However, as a result of sudden increase of mobile communication users in accordance with spread of the mobile communication for late years, there is a problem in that the number of frequencies (frequency source) becomes short due to call requests more than capacity of frequency channels assigned to the mobile communication system.

Therefore, the Space Division Multiple Access (SDMA), which realizes the communication with the plural users in one (single) frequency band, has been proposed so as to realize expansion of the channel capacity by increasing a utilization efficiency of the frequency. In the SDMA, the plural users are separated by difference in space, by turning a main beam orientation of a directivity of a base station antenna toward a desired user and turning a null orientation of the directivity of the base station antenna toward other users.

As a concrete technique for realizing the SDMA, there is a radio communication technique called as MIMO (Multiple Input Multiple Output), in which the channel capacity is increased by using plural antennas. In the MIMO, it is necessary to install plural antennas for dividing a transmission data into plural signals (streams) and simultaneously transmitting the divided signals.

Japanese Patent Laid-Open No. 2001-313525 (JP-A 2001-313525) proposes a mobile communication base station antenna for realizing the SDMA, in which plural array antennas are located linearly (on a straight line) or annularly (on a circumference of a circle).

In addition, K. Nishimori et al, "Channel Capacity Measurement of 8×2 MIMO Transmission by Antenna Configurations in an Actual Cellular Environment", IEEE TRANSACTIONS ON ANTENNAS AND PROPAGATION, VOL. 54, No. 11, November, 2006, pp. 3285-3291 proposes a mobile communication base station antenna for realizing the SDMA, in which four array antennas using V-H (vertical and horizontal) polarized wave and ±45 degree slant polarized wave are arranged in a horizontal direction.

In late years, in accordance with spread of mobile communication including portable telephone, the mobile communication base station antennas overflow all over the town. The mobile communication base station antenna is generally installed on a steel tower or a roof of a high building. Therefore, it is unfavorable that an installation occupied area (i.e. an area occupied for installation) of the mobile communication base station antenna in total is increased, since the increase in the installation occupied area raises the cost for installation or damages the landscape.

Further, it is also unfavorable that plural array antennas are arranged linearly along a longitudinal direction of an antenna, since such an arrangement may cause the problems in the installation or in the landscape.

Still further, as to the array antenna, since the number of antenna elements constituting an array antenna is determined based on an antenna directivity required in the mobile communication base station, it is impossible to reduce the number of the antenna elements even though there is the problems in the installation or in the landscape.

For the case of introducing the aforementioned MIMO technique, it is indispensable to arrange the plural array antennas so as to increase the channel capacity by improving the utilization efficiency of the frequency. However, as described above, it is unfavorable that the installation occupied area of the antenna in total is increased.

Accordingly, in recent years, it has been strongly desired to realize the mobile communication base station antenna which enables the SDMA without increasing the installation occupied area.

SUMMARY OF THE INVENTION

However, in the conventional antenna devices proposed by JP-A 2001-313525 and Nishimori et al, there is a problem in that the installation occupied area of the mobile communication base station antenna in total is increased since the array antennas are disposed linearly or annularly (on a circumference).

For realizing the SDMA without largely increasing the installation occupied area of the mobile communication base station antenna in total by using the technique other than the techniques disclosed by JP-A 2001-313525 and Nishimori et al, technique of reducing an interval (distance) between two array antennas may be proposed. However, if the interval between the two array antennas is reduced, there will be another problem in that antenna characteristic such as antenna gain is deteriorated due to the decrease in isolation between the two array antennas.

As described above, according to the conventional techniques, it has been significantly difficult or impossible to realize the SDMA while avoiding the increase in the installation occupied area of the mobile communication base station antenna in total.

On the other hand, as described above, there has been the request for reducing the installation occupied area of the mobile communication base station antenna when constituting the mobile communication base station antenna by using the two array antennas. As a condition precedent to the above request, it has been demanded to avoid the deterioration of the antenna characteristics of the two array antennas themselves when using the two array antennas. Even though the installation occupied area of the mobile communication base station antenna can be reduced, if the antenna characteristics of respective two array antennas are deteriorated, such an antenna does not serve as the mobile communication base station antenna.

Therefore, an object of the present invention is to solve the above problem and to provide a mobile communication base station antenna for realizing the SDMA without deteriorating the antenna characteristics even when the mobile communication base station antenna is constituted by using plural array antennas.

According to a feature of the invention, a mobile communication base station antenna comprising:

at least two array antennas juxtaposed in a horizontal direction and comprising a first array antenna and a second array antenna, each of the first and second array antennas including antenna elements arranged in a vertical direction, each of the antenna elements having the same polarization characteristics;

a first feeding port and a second feeding port for feeding a power to the first and second array antennas;

in which the first feeding port is connected to a part of the antenna elements in the first array antenna and a part of the antenna elements in the second array antenna, in which the second feeding port is connected to a remaining part of the antenna elements in the first array antenna and a remaining part of the antenna elements in the second array antenna.

The antenna elements may be classified into a first group to an Nth group (N is an integer, and equal to or more than 3), each of which comprises at least two antenna elements, in which the first feeding port may be connected to the antenna elements in an odd number group of the first array antenna and the antenna elements in an even number group of the second array antenna, in which the second feeding port may be connected to the antenna elements in an even number group of the first array antenna and the antenna elements in an odd number group of the second array antenna.

The N may be 3 and the antenna elements may be classified into the first group, a second group, and a third group, in which the sum of the number of the antenna elements in the first group and the number of the antenna elements in the third group may be equal to the number of the antenna elements in the second group.

Further, the number of the antenna elements in the first group may be equal to the number of the antenna elements in the third group.

Still further, a total power to be supplied to the antenna elements in the first group may be equal to a total power to be supplied to the antenna elements in the third group.

In addition, a sum of a total power to be supplied to the antenna elements in the first group and a total power to be supplied to the antenna elements in the third group may be equal to a total power to be supplied to the antenna elements in the second group.

The mobile communication base station antenna may further comprise:

a shield plate provided between the first and second array antennas for shielding an electromagnetic interference between the first and second array antennas.

The mobile communication base station antenna may further comprise:

a power divider connected to each of the first and second feeding ports, for dividing the power to the first and second array antennas, in which powers divided into two power feeding systems are substantially equal to each other.

The powers divided into the two power feeding systems may be respectively supplied to the antenna elements that are equal in number in the first and second array antennas, respectively.

Each of the powers divided into the two power feeding systems may be supplied to antenna elements having at least one continued portion in an antenna element arrangement in each of the first and second array antennas.

The powers divided into the two power feeding systems may be supplied to only one of two antenna elements juxtaposed in the horizontal direction to sandwich the shield plate.

One of the powers divided into the two power feeding systems may be supplied to antenna elements located at an upper portion in the vertical direction in the first array antenna, and an other of the powers divided into the two power feeding systems may be supplied to antenna elements located at a lower portion in the vertical direction in the second array antenna.

The shield plate may comprise a plurality of shied plates provided in parallel with a predetermined interval between the two array antennas adjacent to each other.

The shield plate may comprise a metal or other conductor.

Each of the antenna elements may comprise an antenna element pair comprising two antenna elements combined with each other, in which the two antenna elements have polarization characteristics perpendicular to each other or crossed at a predetermined angle.

The two array antennas may be used for a Space Division Multiple Access communication.

The antenna element is not limited to a simple antenna element, and may include an antenna element pair having antenna elements that are combined with each other.

In the mobile communication base station antenna of the present invention, at least two antennas are juxtaposed in a horizontal direction. Each of the two array antennas includes a plurality of antenna elements arranged in a vertical direction, and each of the antenna elements has the same polarization characteristics. For example, the two array antennas may be juxtaposed in the horizontal direction. Also, the three array antennas may be juxtaposed in the horizontal direction.

In the case that the two array antennas are juxtaposed in the horizontal direction, the mobile communication base station antenna comprises the first and second feeding ports for feeding the power to the two array antennas. In other words, the mobile communication base station antenna comprises the two feeding ports for the two array antennas. In the case that the V-H polarized wave antenna element pair or the ±45 degree slant polarized wave antenna element pair is used as the antenna element in the array antenna, four feeding ports in total may be required for using such antenna element pairs. The concept of the present invention also includes the aforementioned cases. Namely, the power is supplied to the two array antennas by the two feeding ports in the present invention including the aforementioned cases.

The first feeding port is connected to a part of the antenna elements in the first array antenna and a part of the antenna elements in the second array antenna, and the second feeding port is connected to a remaining part of the antenna elements in the first array antenna and a remaining part of the antenna elements in the second array antenna.

POINTS OF THE INVENTION

According to the mobile communication base station antenna of the present invention, the first feeding port distributes the power to a part of the antenna elements in the first array antenna and a part of the antenna elements in the second array antenna, and the second feeding port distributes the power to a remaining part of the antenna elements in the first array antenna and a remaining part of the antenna elements in the second array antenna, differently from the structure in which the first feeding port feeds the power to all the antenna elements in the first array antenna, and the second feeding port feeds the power to all the antenna elements in the second array antenna.

As a result, the bias in the power feeding (the imbalanced power feeding) can be reduced, since the power supplied from the first feeding port is supplied to not only the first array antenna but also the second array antenna and the power supplied from the second feeding port is supplied to not only the second array antenna but also the first array antenna. Since the bias in the power feeding is reduced, it is possible to suppress the tilting of the horizontal plane main beam radiated from each array antenna with respect to the antenna front direction, so that it is possible to suppress the deterioration of the antenna characteristics.

According to the present invention, it is possible to provide the mobile communication base station antenna technique, by which the antenna characteristics are not deteriorated even though the mobile communication base station antenna is constituted by using a plurality of array antennas.

BRIEF DESCRIPTION OF THE DRAWINGS

Next, the mobile communication base station antenna in preferred embodiments according to the invention will be explained in conjunction with appended drawing, wherein:

FIGS. 2A to 2D are diagrams showing the mobile communication base station antenna 10 in the first preferred embodiment according to the invention, wherein FIG. 2A shows a front view thereof, FIG. 2B shows a plan view (bottom view) thereof, FIG. 2C shows an antenna element, and FIG. 2D shows another antenna element;

FIGS. 3A and 3B are schematic diagrams showing the mobile communication base station antenna 10 in the first preferred embodiment according to the invention, wherein FIG. 3A shows a front view thereof, and FIG. 3B shows a plan view (bottom view) thereof;

DETAILED DESCRIPTION OF THE PREFERRED EMBODIMENTS

Next, the preferred embodiments of the present invention will be described in more detail in conjunction with the appended drawings.

First Preferred Embodiment

Figure 1:
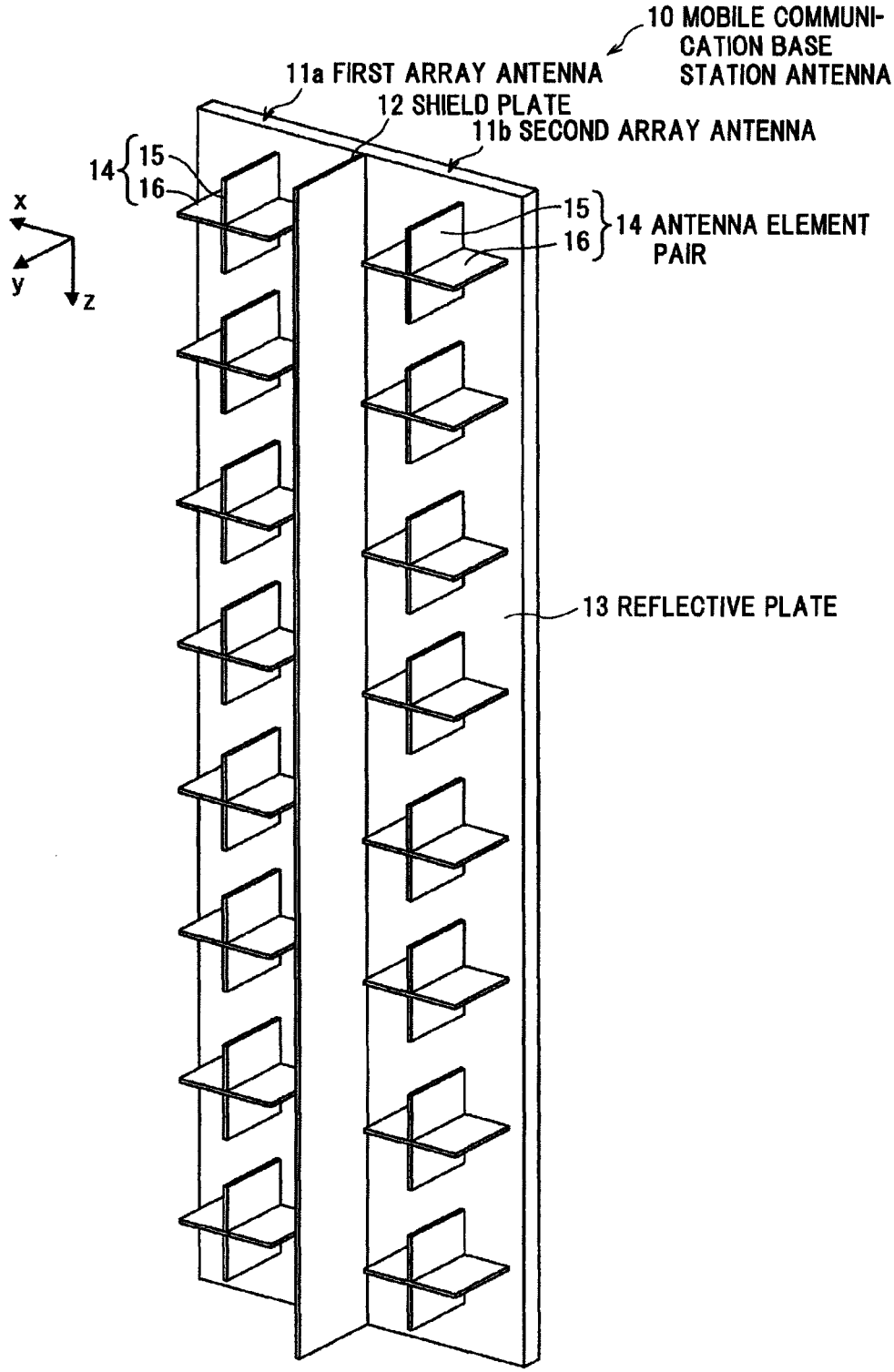
FIG. 1 is a perspective view of a mobile communication base station antenna 10 in the first preferred embodiment according to the invention.

FIG. 1 is a perspective view of a mobile communication base station antenna 10 in the first preferred embodiment according to the invention.

FIGS. 2A to 2D are diagrams showing the mobile communication base station antenna 10 in the first preferred embodiment according to the invention. FIG. 2A is a front view of the mobile communication base station antenna 10. FIG. 2B is a plan view (bottom view) of the mobile communication base station antenna 10. FIG. 2C is a diagram showing an antenna element 15 as a single body. FIG. 2D is a diagram showing another antenna element 16 as a single body.

(Structure of the Mobile Communication Base Station Antenna 10)

Referring to FIG. 1, a mobile communication base station antenna 10 in the first preferred embodiment is an antenna used for the SDMA (Space Division Multiplex Access) communication. For example, the mobile communication base station antenna 10 is used for a radio communication technique called as Multiple Input Multiple Output (MIMO) for increasing a channel capacity by using plural antennas. In the MIMO, a transmission data is divided into a plurality of signal data and transmitted at the same time (simultaneously).

Therefore, in the MIMO, it is demanded that the plurality of antennas are installed, so that the plural antennas should be installed. In the present preferred embodiment, two array antennas (a first array antenna 11*a* and a second array antenna 11*b*) are juxtaposed (located in parallel and adjacent to each other) in a horizontal direction (x-direction in FIG. 1, namely in a width direction with respect to a front surface of a reflective plate 13).

Referring to FIG. 2A, the mobile communication base station antenna 10 comprises two array antennas 11*a*, 11*b* juxtaposed in a horizontal direction such that the shield plate 12 is provided between the two array antennas 11*a*, 11*b*. Each of the array antennas 11*a*, 11*b* includes eight antenna element pairs 14 arranged in a vertical direction. Each of the antenna element pairs 14 comprises two antenna elements 15 and 16 having polarization characteristics perpendicular to each other, and the antenna element (vertical polarized wave antenna element) 15 and the antenna element (horizontal polarized wave antenna element) 16 are combined to have a cruciform cross section. The antenna element pair 14 can use both of a radio wave polarized by the vertical polarized wave antenna element 15 and a radio wave polarized by the horizontal polarized wave antenna element 16 to transmit and/or receive signals.

Referring to FIG. 1 and FIG. 2B, the antenna element pairs 14 are arranged on the reflective plate 13. The shield plate 12 provided between the two antenna element pairs 14 has a height higher than heights of the antenna element pairs 14 so as to further suppress the electromagnetic interference between the adjacent antenna element pairs 14.

(Structure of the Antenna Element Pair 14)

Here, the antenna element pair 14 is explained in more detail. The antenna element pair 14 is constituted by combining the vertical polarized wave antenna element 15 and the horizontal polarized wave antenna element 16. A printed dipole antenna may be used for the vertical polarized wave antenna element 15 and the horizontal polarized wave antenna element 16, respectively. More concretely, each of the vertical polarized wave antenna element 15 and the horizontal polarized wave antenna element 16 comprises a dielectric substrate having a substantially rectangular shape in its front view as a base, and a dipole element, a feeding line conductor, and a grounding conductor, etc. that are provided on the rectangular dielectric substrate.

More concretely, referring to FIG. 2C, the vertical polarized wave antenna element 15 is provided with a slit S1 which extends from an upper end side toward a lower end side of the vertical polarized wave antenna element 15 to have a predetermined length.

Referring to FIG. 2D, contrary to the vertical polarized wave antenna element 15, the horizontal polarized wave antenna element 16 is provided with a slit S2, which extends from a lower end side toward an upper end side to have a predetermined length.

The horizontal polarized wave antenna element 16 is pressed down into the vertical polarized wave antenna element 15 such that the slit S1 and the slit S2 are engaged with each other. As a result, the vertical polarized wave antenna element 15 and the horizontal polarized wave antenna element 16 are combined with each other in a crossed state, thereby forming the antenna element pair 14.

Figure 3A:
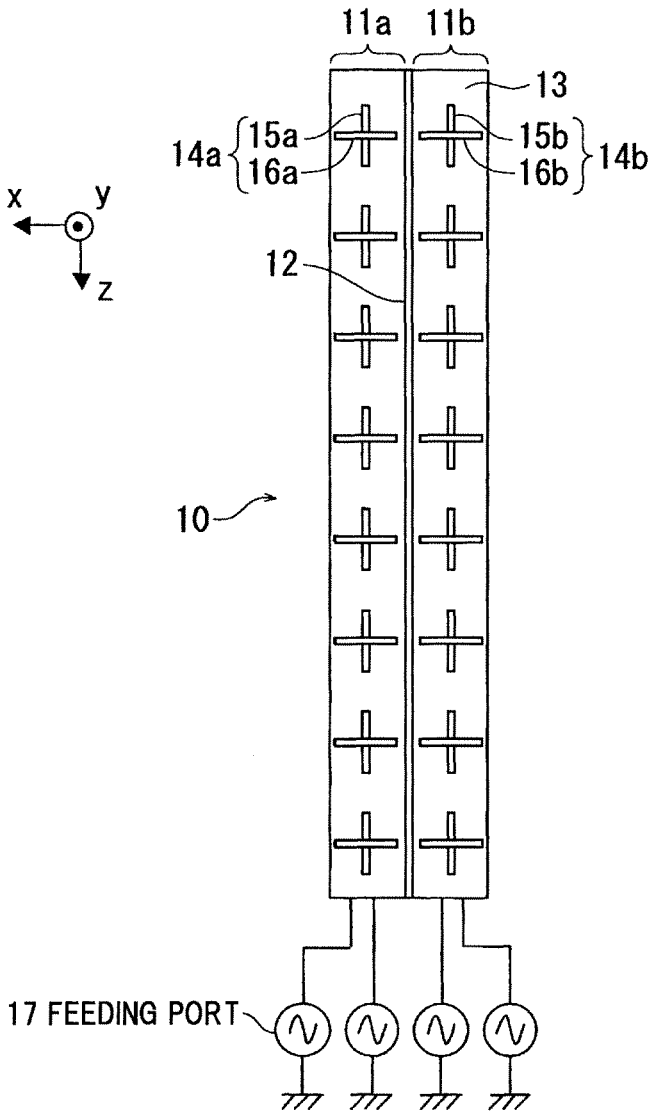
Figure 3B:
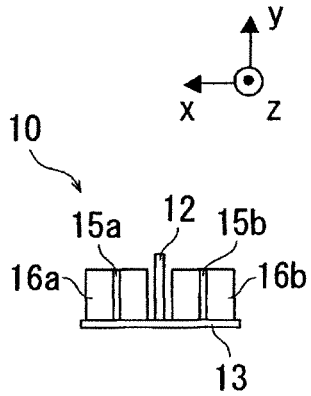

FIGS. 3A and 3B are schematic diagrams showing the mobile communication base station antenna 10 in the first preferred embodiment according to the invention. FIG. 3A shows a front view of the mobile communication base station antenna 10. FIG. 3B shows a plan view (bottom view) of the mobile communication base station antenna 10.

More concretely, a main part of the mobile communication base station antenna 10 comprises the first and second array antennas 11*a*, 11*b* that are juxtaposed in a horizontal direction (i.e. the x-direction of FIG. 3), the shield plate 12 provided between the first and second array antennas 11*a*, 11*b*, and the reflective plate 13 provided on the back of the first and second array antennas 11*a*, 11*b*. Herein, the first and second array antennas 11*a*, 11*b* are called collectively as "array antenna 11". Further, the array antenna may be also called as "antenna element pair array". In the following explanation, a suffix "a" is assigned to a reference numeral in each of constitutive elements included in the first array antenna 11*a*, and a suffix "b" is assigned to a reference numeral in each of constitutive elements included in the second array antenna 11*b*. When the respective constitutive elements are collectively called, the suffix "a" or "b" is not assigned to the reference numerals.

The first array antenna 11*a* includes eight antenna element pairs 14*a*, which are arranged in a vertical direction (z-direction in FIG. 3, namely in a longitudinal direction of a front surface of the reflective plate 13) of the mobile communication base station antenna 1, respectively. In a like manner, the second array antenna 11*b* includes eight antenna element pairs 14*b* that are arranged in the vertical direction. The antenna element pairs 14*a* and 14*b* are antenna element pairs having the same polarization characteristics, and arranged in the vertical direction with the same pitch.

Each of the antenna element pairs 14 comprises a pair of the vertical polarized wave antenna element 15 and the horizontal polarized wave antenna element 16 that are combined to be perpendicular to each other. Each antenna element may comprise a print dipole antenna as described above. In addition, each antenna element may comprise a half wavelength dipole antenna, a patch antenna, or the like.

The shield plate 12 is positioned between the first array antenna 11*a* and the second array antenna 11*b* to extend along the vertical direction (the z-direction in FIG. 1). The shield plate 12 shields electromagnetic interference etc. between the first and second array antennas 11*a* and 11*b* (mainly along the x-direction in FIG. 1), thereby surely providing excellent isolation between the first and second array antennas 11*a* and 11*b*.

The shield plate 12 may comprises a shield plate made from a metal or other conductor. In addition, the shield plate 12 may comprise a wave absorber made from a magnetic substance or a dielectric material.

The reflective plate 13 is provided on the back surface of the first and second array antennas 11*a* and 11*b*. The reflective plate 13 is provided for surely providing a total directivity (e.g. directivity for the y-direction as the main axis in FIG. 1) of each of the first and second array antennas 11*a* and 11*b* in the mobile communication base station antenna 10.

The mobile communication base station antenna 1 further comprises four (in total) feeding ports 17 for feeding electric power to the array antenna 11. The four feeding ports 17 are set to distribute substantially equal electric powers to a vertical polarized wave antenna element 15*a*, a vertical polarized wave antenna element 15*b*, a horizontal polarized wave antenna element 16*a*, and a horizontal polarized wave antenna element 16*b*, respectively.

(Function of the Mobile Communication Base Station Antenna 10)

Next, the function of the mobile communication base station antenna 10 in the first preferred embodiment according to the invention will be explained below.

In the conventional technique, it has been difficult to obtain the isolation between two array antennas that are juxtaposed (i.e. adjacent to each other in parallel) in the horizontal direction. As a result, there has been a problem in that the distance between the array antennas should be increased so that the antenna installation occupied area (i.e. the occupied area for installing the antenna) should be increased.

However, in the mobile communication base station antenna 10 in the first preferred embodiment, the shield plate 12 extending along the vertical direction is provided between the first and second array antennas 11*a* and 11*b* that are juxtaposed in the horizontal direction, so that the isolation between the first and second array antennas 11*a* and 11*b* can be remarkably improved by the means of the shield plate 12. As a result, it is no longer necessary to dispose the first and second array antennas 11*a* and 11*b* with a large distance, so that it is possible to avoid the increase in the antenna installation occupied area.

Figure 4A:
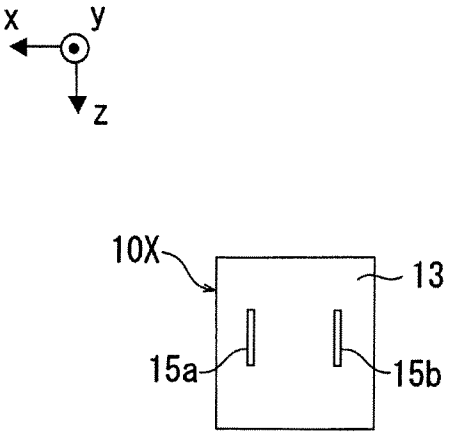
FIGS. 4A to 4D are explanatory diagrams for explaining function and effect of a shield plate 12.
Figure 4B:
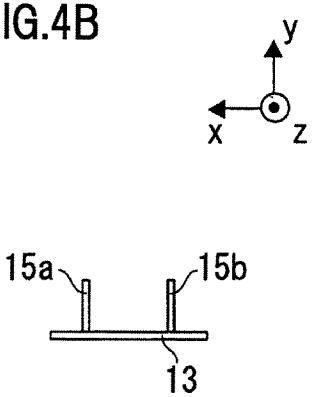
Figure 4C:
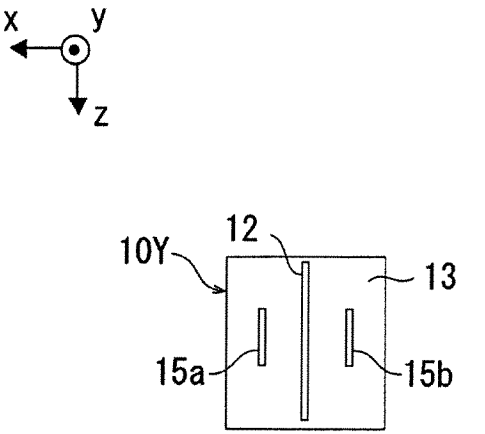
Figure 4D:
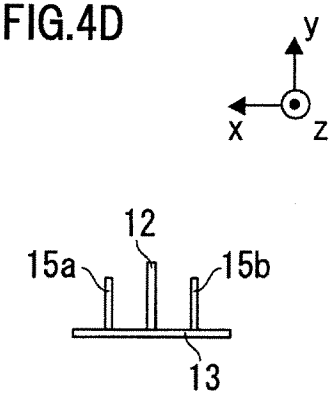

FIGS. 4A to 4D are explanatory diagrams for explaining the function and effect of the shield plate 12. FIGS. 4A and 4B shows an example in which no metallic shield plate is provided, and FIGS. 4C and 4D shows an example in which a metallic shield plate 12 is provided. Herein, for the purpose of simplifying the explanation, a model, in which the vertical polarized wave antenna elements 15*a* and the vertical polarized wave antenna elements 15*b* are provided respectively for left and right sides, is used instead of the antenna element pairs 14, each of which is formed by combining the vertical polarized wave antenna element 15 and the horizontal polarized wave antenna element 16 as one pair to be perpendicular to each other.

Referring to FIG. 4A (a front view) and FIG. 4B (a plan view), a mobile communication base station antenna 10X is an antenna, which does not comprise a shield plate 12, but comprises a vertical polarized wave antenna element 15*a* connected to a feeding port (not shown), a vertical polarized wave antenna element 15*b* connected to a 50-ohm terminal, and a reflective plate 13.

On the other hand, referring to FIG. 4C (a front view) and FIG. 4D (a plan view), a mobile communication base station antenna 10Y is an antenna, which comprises a shield plate 12. As to other elements, similarly to the antenna 10X, the antenna 10Y comprises a vertical polarized wave antenna element 15*a* connected to a feeding port (not shown), a vertical polarized wave antenna element 15*b* connected to a 50-ohm terminal, and a reflective plate 13. The reflective plate 13 and the shield plate 20 are electrically connected to each other.

Simulation of an electromagnetic coupling quantity between the vertical polarized wave antenna element 15*a* and the vertical polarized wave antenna element 15*b* in the antenna 10X was carried out. The simulation result of the antenna 10X was −9.0 dB. On the other hand, the simulation result of the electromagnetic coupling quantity between the vertical polarized wave antenna element 15*a* and the vertical polarized wave antenna element 15*b* in the antenna 10Y was −27.1 dB.

Based on the above simulation result, it was confirmed that the isolation between the vertical polarized wave antenna elements 15*a* and 15*b* was remarkably improved by providing the shield plate 12 between the adjacent vertical polarized wave antenna elements 15*a* and 15*b*, so that it is no longer necessary to increase the distance (spacing) between the adjacent antenna elements.

In other words, by providing the shield plate 12 between the adjacent vertical polarized wave antenna elements 15*a* and 15*b*, it is possible to solve the problem in the conventional mobile communication base station antenna, namely, the antenna characteristics such as the directivity is deteriorated due to the forcible decrease in the distance between the vertical polarized wave antenna elements 15*a* and 15*b* for avoiding the increase in the installation occupied area.

As described above, according to the mobile communication base station antenna 10 in the first preferred embodiment, it is possible to realize the space division communication with the excellent directivity such as the SDMA without deteriorating the antenna characteristics such as the directivity mainly and without increasing the entire occupation area for installing the mobile communication base station antenna 10.

Further, for the case of arranging three or more array antennas in the horizontal direction, the above effects can be obtained by providing the shield plate 12 between the respective array antennas. In other words, similarly to the first preferred embodiment, it is possible to realize the mobile communication base station antenna 10, by which the space division communication such as the SDMA can be carried out without deteriorating the antenna characteristics and without largely increasing the installation occupied area.

Figure 5B:
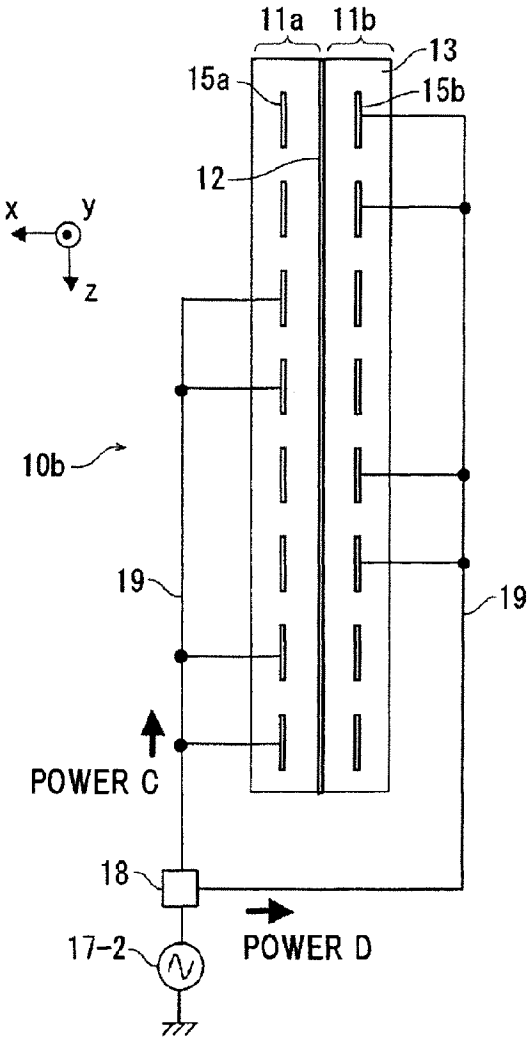
FIGS. 5A and 5B are explanatory diagram showing an embodiment of a structure for electrical connection between a vertical polarized wave antenna element and a feeding port in the mobile communication base station antenna 10 (10*a*, 10*b*) in the first preferred embodiment.
Figure 5A:
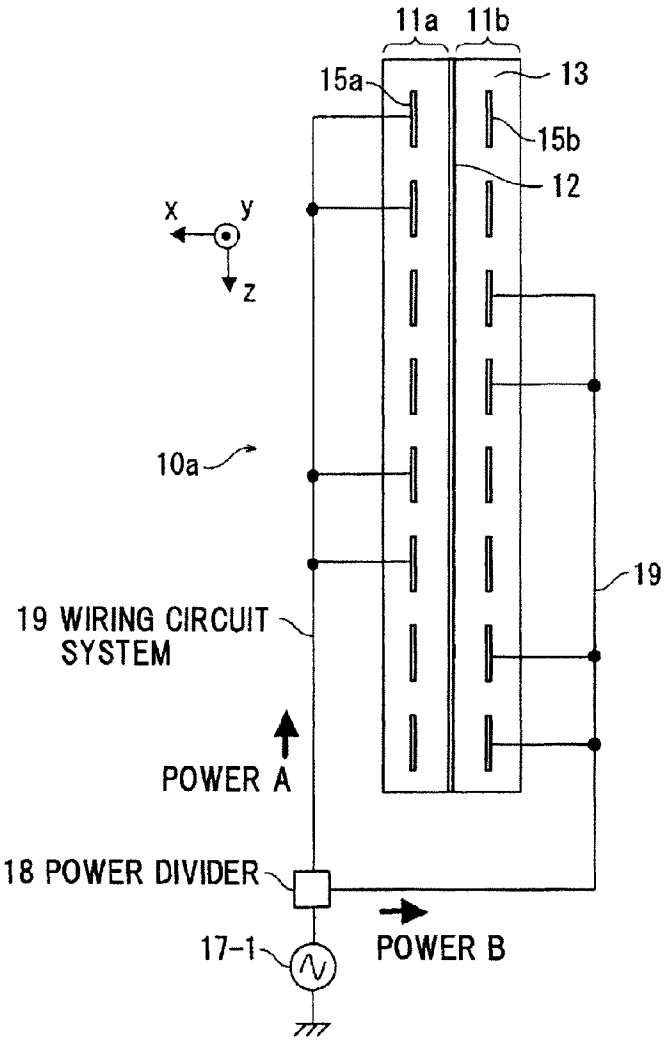

FIGS. 5A and 5B are explanatory diagram showing an embodiment of a structure for electrical connection between vertical polarized wave antenna elements and feeding ports in the mobile communication base station antenna 10 (10*a*, 10*b*) in the first preferred embodiment.

Herein, for the purpose of simplifying the explanation, a model, in which the horizontal polarized wave antenna elements 16 are omitted and only the vertical polarized wave antenna elements 15 are provided, is used instead of the antenna element pairs 14, each of which is formed by combining the vertical polarized wave antenna element 15 and the horizontal polarized wave antenna element 16 as one pair to be perpendicular to each other. Further, FIGS. 5A and 5B show the mobile communication base station antenna 10 that are divided into mobile communication base station antennas 10*a* and 10*b* by each power feeding system, so as to avoid the complication of illustration for the convenience of the explanation. Therefore, the mobile communication base station antenna 10 has, in practice, the structure in which the power feeding system shown in FIG. 5A and the power feeding system shown in FIG. 5B are combined. Hereinafter, the mobile communication base station antenna in the respective preferred embodiments will be explained similarly.

Referring to FIGS. 5A and 5B, the mobile communication base station antenna 10 in the present preferred embodiment comprises a first feeding port 17-1 and a second feeding port 17-2 for feeding the power to two array antennas 11*a* and 11*b*.

Referring to FIG. 5A, in the mobile communication base station antenna 10*a* with one power feeding system, the first feeding port 17-1 is connected to a power divider 18. The power divider 18 is set to distribute the power supplied from the first feeding port 17-1 to the array antennas 11*a* and 11*b* at a ratio of A:B. Each power is distributed to each of the array antennas 11*a* and 11*b* via a wiring circuit system 19. The power can be distributed by using the power divider 18 with good efficiency.

Referring to FIG. 5B, in the mobile communication base station antenna 10*b* with the other power feeding system, the second feeding port 17-2 is connected to the power divider 18. The power divider 18 is set to distribute the power supplied from the second feeding port 17-2 to the array antennas 11*a* and 11*b* at a ratio of C:D. Each power is distributed to each of the array antennas 11*a* and 11*b* via the wiring circuit system 19. Herein, the value A is substantially equal to the value B. The values C and D are set to be substantially equal to each other.

In both of the mobile communication base station antennas 10*a* and 10*b* having respective power feeding systems as shown in FIGS. 5A and 5B, the number of the antenna elements 15 to which the power is supplied from the feeding port 17 in the first array antenna 11*a* is four, and the number of the antenna elements 15 to which the power is supplied from the feeding port 17 in the second array antenna 11*b* is four. Namely, the number of the antenna elements 15 to which the power is supplied in the first array antenna 11*a* is equal to the number of the antenna elements 15 to which the power is supplied in the second array antenna 11*b*.

Namely, in each power system, the power is divided into two systems (power feeding systems) for the two array antennas 11*a* and 11*b* by the power divider 18, and the divided powers are respectively distributed to the antenna elements in the first array antennas 11*a* and the antenna elements in the second array antenna 11*b* that are equal in number. However, focusing on every two polarized wave antenna elements 15*a*, 15*b* that are juxtaposed in the horizontal direction with respect to the shield plate 12 as a center (i.e. located to sandwich the shield plate 12), the powers divided by the power divider 18 into the two power feeding systems, i.e. the two array antennas 11*a* and 11*b*, are set to be distributed to only one of the polarized wave antenna elements 15*a* and 15*b* and not distributed to the other one. According to such a power feeding system, the bilateral symmetry in the power feeding can be further improved.

Further, the vertical polarized wave antenna elements 15, to which the power is supplied, in one array antenna 11 are selected such that the power is supplied to two adjacent (continued) vertical polarized wave antenna elements 15 and not to the next two adjacent vertical polarized wave antenna elements 15 alternately in a linear arrangement of the one array antenna 11 (i.e. "two by two, alternately"). By distributing the power to the vertical polarized wave antenna elements 15 in such a continuous arrangement, the power distribution can be concentrated to some extent. Therefore, according to this structure, the inter-port isolation can be reduced compared with the arrangement in which the vertical polarized wave antenna element 15, to which the power is supplied, and the vertical polarized wave antenna element 15, to which the power is not supplied, are arranged one by one alternately in the linear arrangement of the array antenna 11.

As described above, in the first preferred embodiment, referring to FIG. 5A, the first feeding port 17-1 is connected to a part of the antenna elements 15 (i.e. the first, second, fifth and sixth antenna elements 15*a*) in the first array antenna 11*a* and a part of the antenna element 15 (i.e. the third, fourth, seventh and eighth antenna elements 15*b*) in the second array antenna 11*b* in the two array antennas 11*a* and 11*b*. Herein, the numbering of the antenna elements is determined in accordance with the order from the upper side to the lower side in the vertical direction. Hereinafter, the same numbering is used.

Further, referring to FIG. 5B, the second feeding port 17-2 is connected to a remaining part of the antenna elements 15 (i.e. the third, fourth, seventh and eighth antenna elements 15*a*) in the first array antenna 11*a* and a remaining part of the antenna element 15 (i.e. the first, second, fifth and sixth antenna elements 15*b*) in the second array antenna 11*b* in the two array antennas 11*a* and 11*b*.

In the first preferred embodiment, eight antenna elements 15 are arranged in the vertical direction. The antenna elements 15 are connected to the feeding port 17 two by two (two elements, two elements, two elements, and two elements) alternately in the order from the upper side to the lower side in the vertical direction (8-elements; 2-2-2-2 distribution).

Figure 6A:
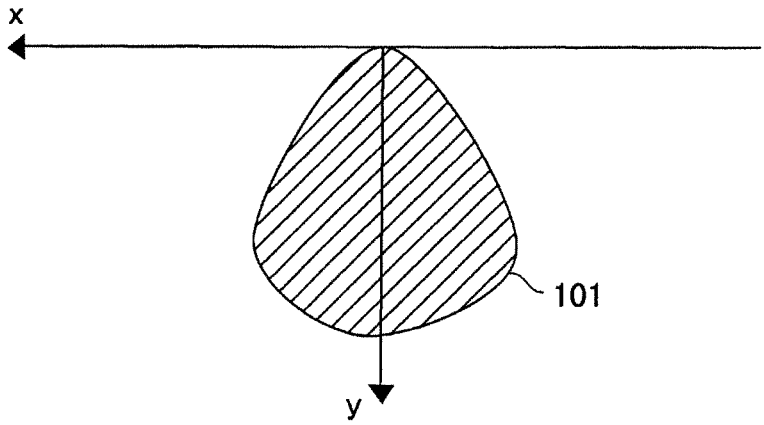
FIGS. 6A and 6B are graphs showing a main beam radiation pattern in a horizontal plane (x-y plane) in each of the mobile communication base station antennas 10*a*, 10*b;*

FIGS. 6A and 6D are graphs showing a main beam radiation pattern in a horizontal plane (x-y plane) in each of mobile communication base station antenna 10*a*, 10*b*.

Figure 6B:
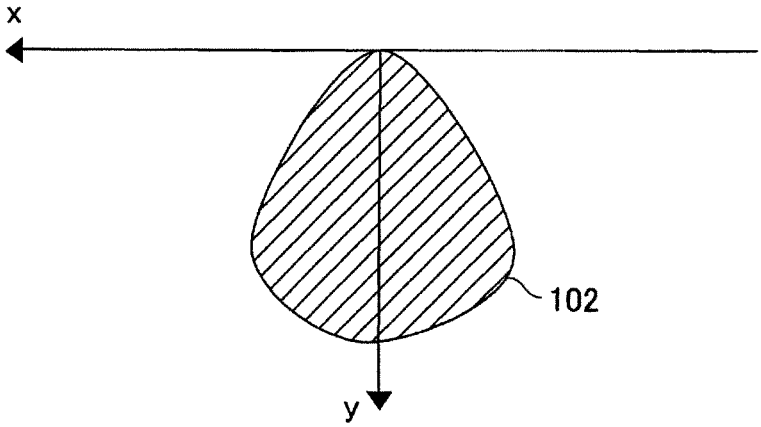

In both of the mobile communication base station antennas 10*a* and 10*b*, a horizontal plane main beam 101 of the first array antenna 11*a* (FIG. 6A; a horizontal plane main beam from the mobile communication base station antenna 10*a*) and a horizontal plane main beam 102 of the first array antenna 11*b* (FIG. 6B; a horizontal plane main beam from the mobile communication base station antenna 10*b*) are oriented toward an antenna front direction (i.e. a front direction of the antenna: the y-direction). It is because that the substantially equal powers are supplied to the first and second array antennas 11*a* and 11*b* so that the radiation conductor structure in the horizontal plane is a substantially symmetrical structure with respect to the antenna front direction (the y-direction).

Next, the definition of the level of "substantially equal" in the above case will be explained below. For example, even though slight difference in the power feeding due to interfusion of disturbance or error or the like occurs, such a difference in the power feeding will not substantially cause a significant bias (imbalance) on the horizontal plane main beams 101 and 102 of the array antenna 11. For the purpose of simplifying the expression, the term "equal" will be simply used hereinafter to include the case of "substantially equal" as described above.

For example, when the antenna elements 15 with the odd number (e.g. 9) in the array antenna 11 are divided into two groups of a substantially upper half part and a substantially lower half part, it is possible to divide the antenna elements 15 into two groups of e.g. upper four elements and lower five elements, or, alternatively, upper five elements and lower four elements, etc.

Comparative Example

Figure 7B:
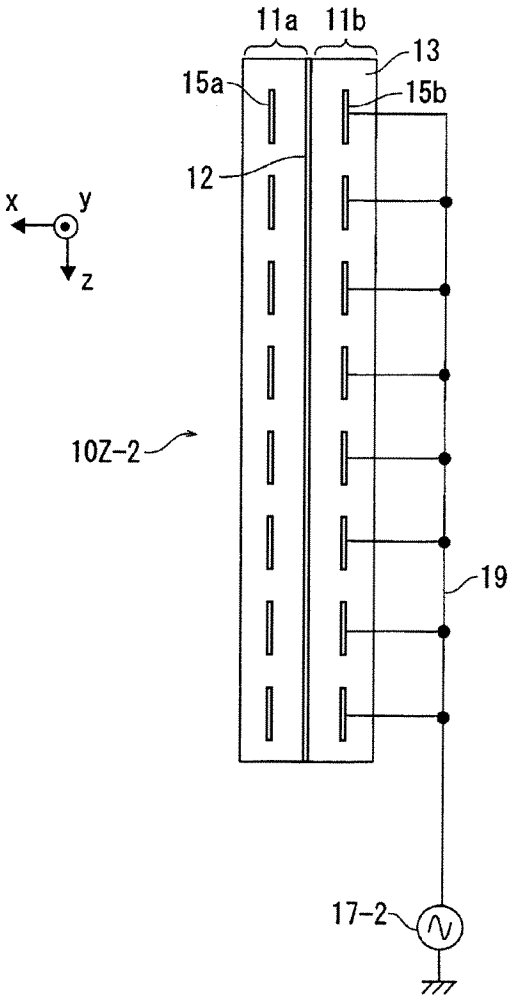
FIGS. 7A and 7B are schematic diagrams showing mobile communication base station antennas 10Z-1, 10Z-2 in a comparative example.
Figure 7A:
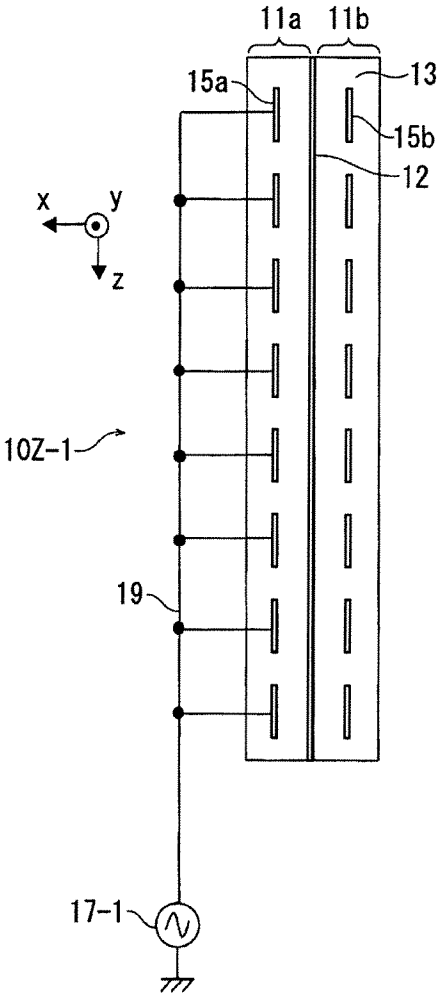

FIGS. 7A and 7B are schematic diagrams showing mobile communication base station antennas 10Z-1, 10Z-2 in a comparative example.

Figure 8A:
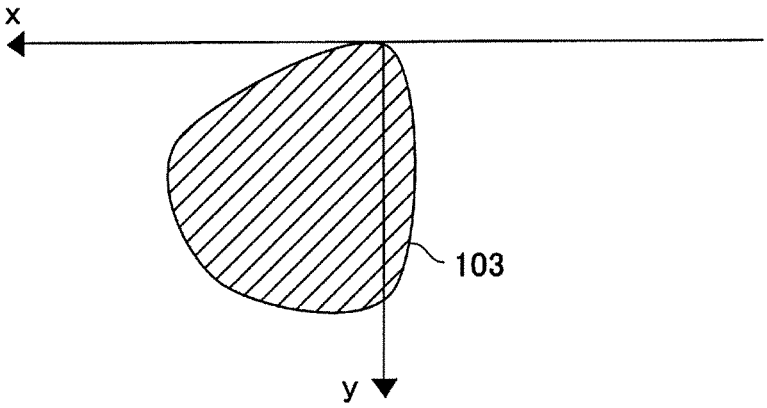
FIGS. 8A and 8B are graphs showing a main beam radiation pattern in a horizontal plane (x-y plane) in each of the mobile communication base station antennas 10Z-1, 10Z-2 in the comparative example.
Figure 8B:
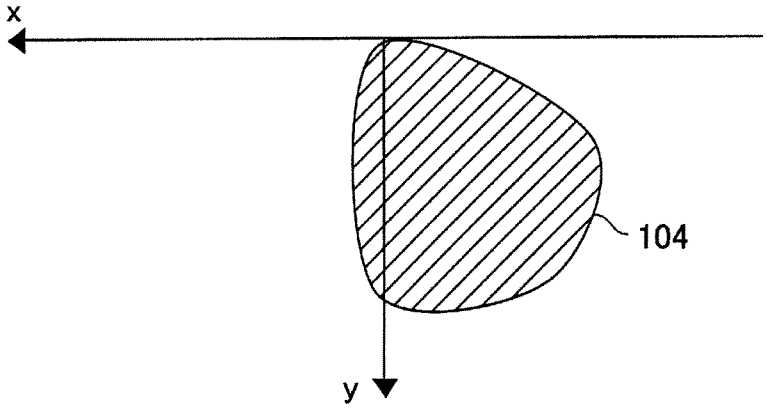

FIGS. 8A and 8B are graphs showing a main beam radiation pattern in a horizontal plane (x-y plane) in each of the mobile communication base station antennas 10Z-1, 10Z-2 in the comparative example.

Referring to FIG. 7A, in the mobile communication base station antenna 10Z in the comparative example, the power is supplied only to a first array antenna 11*a* from a first feeding port 17-1 via a wiring circuit system 19, so that the radiation conductor structure in the horizontal plane is asymmetrical with respect to the antenna front direction. Therefore, as shown in FIG. 8A, a horizontal plane main beam 103 is tilted with respect to the antenna front direction. As a result, there is a disadvantage in that the area design of the mobile communication base station antenna is difficult.

Similar disadvantage will be found in the structure that the power is supplied only to a second array antenna 11*b* from a second feeding port 17-2 via the wiring circuit system 19. However, in the structure as shown in FIG. 7B, the tilt direction of a horizontal plane main beam 104 is opposite to the tilt direction of the horizontal plane main beam 103 as shown in FIG. 8B, since the power feeding side in the structure as shown in FIG. 7B is opposite to that in the structure as shown in FIG. 7A.

As described above, according to the mobile communication base station antenna 10 in the first preferred embodiment, the feeding ports 17-1, 17-2 are connected to the antenna elements 15*a*, 15*b* of the first and second array antennas 11*a* and 11*b* by the power divider 18, the power supplied to the first array antenna 11*a* and the power supplied to the second array antenna 11*b* from the single feeding port 17 are set to be substantially equal to each other, and the number of the antenna elements 15*a* to which the power is supplied in the first array antenna 11*a* and the number of the antenna elements 15*b* to which the power is supplied in the second array antenna 11*b* are set to be substantially equal to each other. Therefore, the radiation conductor structure in the horizontal plane is made substantially symmetrical with respect to the antenna front direction. As a result, the horizontal plane main beam is not tilted from the antenna front direction, and the radiation patterns of the horizontal plane main beams 101, 102 of the first and second array antennas 11*a* and 11*b* are substantially equal to each other, so that a desired area design of the mobile communication base station antenna can be realized easily.

Further, according to the mobile communication base station antenna 10 in the first preferred embodiment, as shown in FIGS. 5A and 5B, the power is dispersively distributed to the two array antennas 11*a* and 11*b* from the first feeding port 17-1 and the power is also dispersively distributed to the two array antennas 11*a* and 11*b* from the second feeding port 17-2, not likely in the comparative example as shown in FIGS. 7A and 7B, in which the power is supplied to all the antenna elements 15*a* in the first array antenna 11*a* from the first feeding port 17-1 and the power is supplied to all the antenna elements 15*b* in the second array antenna 11*b* from the second feeding port 17-2. As a result, the bias (imbalance) in the power feeding from the respective feeding ports 17-1, 17-2 can be calibrated, so that it is possible to reduce the tilt of the horizontal plane main beams radiated from the first and second array antennas 11*a*, 11*b* with respect to the antenna front direction, thereby suppress the deterioration of the antenna characteristics.

Second Preferred Embodiment

FIGS. 9A to 9D shows schematic diagrams of a mobile communication base station antenna 20 (20*a*, 20*b*) in the second preferred embodiment according to the invention. FIGS. 9A to 9D are diagrams for showing the electrical connection between vertical polarized wave antenna elements 25, horizontal polarized wave antenna elements 24 and feeding ports 27, which are different from those in the first preferred embodiment. In the following explanation, the same reference numerals or suffixes are assigned to the same parts as in the first preferred embodiment, and the detailed description there of is appropriately omitted.

Figure 9A:
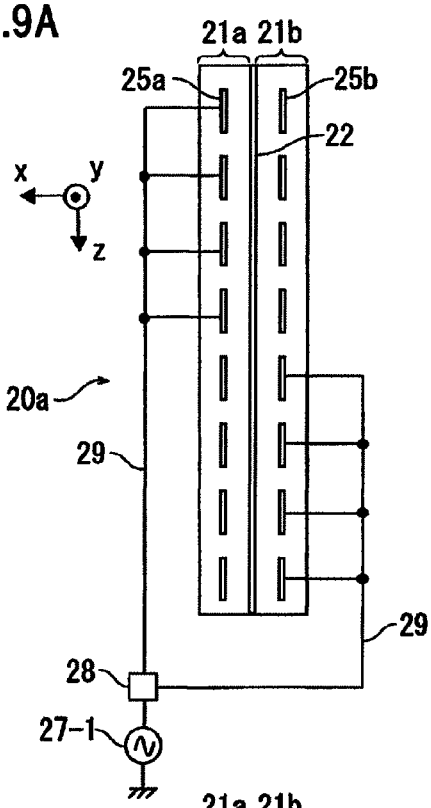
FIGS. 9A to 9D shows schematic diagrams of a mobile communication base station antenna 20 (20*a*, 20*b*) in the second preferred embodiment according to the invention.

Referring to FIG. 9A, in a mobile communication base station antenna 20*a* with one power feeding system, a first feeding port 27-1 is connected to a power divider 28. The power divider 28 is set to distribute the power supplied from the first feeding port 27-1 to the array antennas 11*a* and 11*b* at a ratio of 1:1. Each power is distributed to each of the vertical polarized wave antenna elements 25*a* and 25*b*, respectively.

Figure 9B:
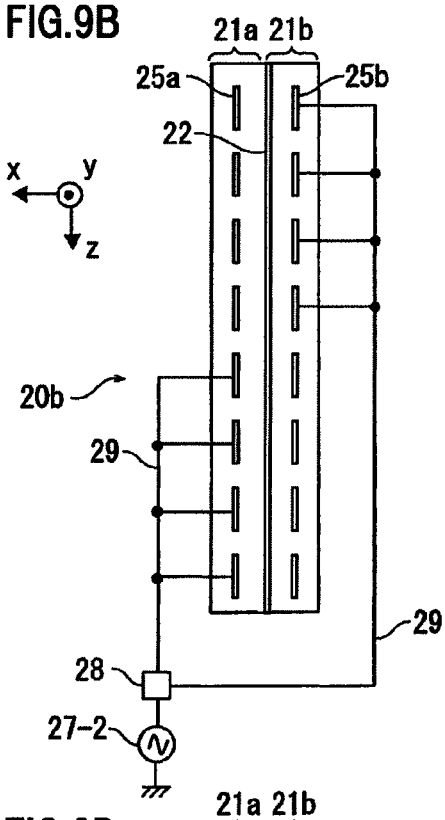

Referring to FIG. 9B, in a mobile communication base station antenna 20*b* with the other power feeding system, a second feeding port 27-2 is connected to the power divider 28. The power divider 28 is set to distribute the power supplied from the second feeding port 27-2 to the array antennas 11*a* and 11*b* at a ratio of 1:1. Each power is distributed to each of the vertical polarized wave antenna elements 25*a* and 25*b*, respectively.

In both of the mobile communication base station antennas 20*a* and 20*b*, the number of the antennal elements 25 to which the power is supplied from the first and second feeding ports 27-1 and 27-2 via the power divider 28 in each array antenna 21 is four, so that the number of the antenna elements is the same for the first and second array antennas 21*a* and 21*b*. However, the arrangement of the vertical polarized wave antenna elements 25*a*, 25*b* to which the power is supplied in the first and second array antennas 21*a* and 21*b* are opposite to each other symmetrically in the mobile communication base station antennas 20*a* and 20*b*.

Figure 9C:
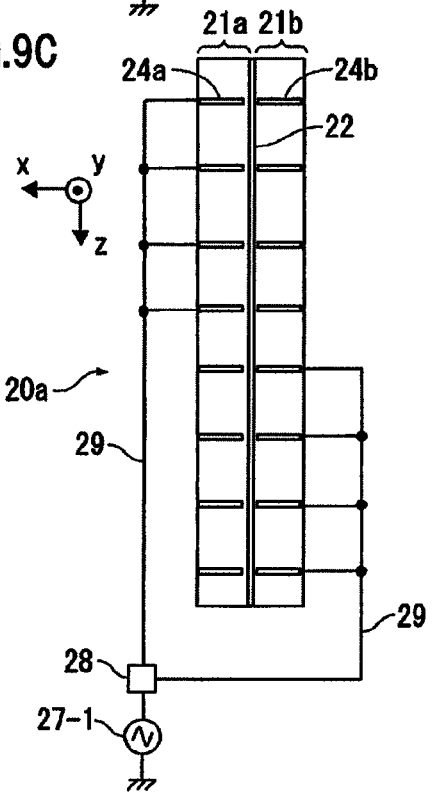

Referring to FIG. 9C, in the mobile communication base station antenna 20*a* with one power feeding system, the first feeding port 27-1 is connected to the power divider 28. The power divider 28 is set to distribute the power supplied from the first feeding port 27-1 to the array antennas 11*a* and 11*b* at a ratio of 1:1. Each power is distributed to each of horizontal polarized wave antenna elements 24*a* and 24*b*, respectively.

Figure 9D:
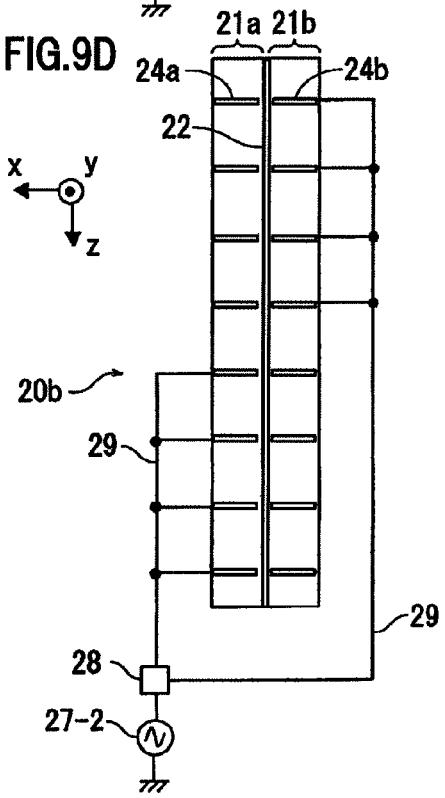

Referring to FIG. 9D, in the mobile communication base station antenna 20*b* with the other power feeding system, the second feeding port 27-2 is connected to the power divider 28. The power divider 28 is set to distribute the power supplied from the second feeding port 27-2 to the array antennas 11*a* and 11*b* at a ratio of 1:1. Each power is distributed to each of horizontal polarized wave antenna elements 24*a* and 24*b*, respectively.

In both of the mobile communication base station antennas 20*a* and 20*b*, the number of the antennal elements 24, 25 to which the power is supplied from the first and second feeding ports 27-1 and 27-2 via the power divider 28 in each array antenna 21 is four, so that the number of the antenna elements 24, 25 is the same for the first and second array antennas 21*a* and 21*b*. However, the arrangement of the horizontal polarized wave antenna elements 24*a*, 24*b* to which the power is supplied in the first and second array antennas 21*a* and 21*b* are opposite to each other symmetrically in the mobile communication base station antennas 20*a* and 20*b*.

As described above, the power is distributed respectively to the respective antenna elements 24, 25 in the first and second array antennas 21*a*, 21*b* that are divided into the upper part and the lower part, so that the symmetry of the power feeding can be improved and the easier wiring can be achieved.

FIGS. 10A to 10D are graphs showing a main beam radiation pattern in a horizontal plane (x-y plane) in each of the mobile communication base station antennas 20*a*, 20*b*.

Figure 10A:
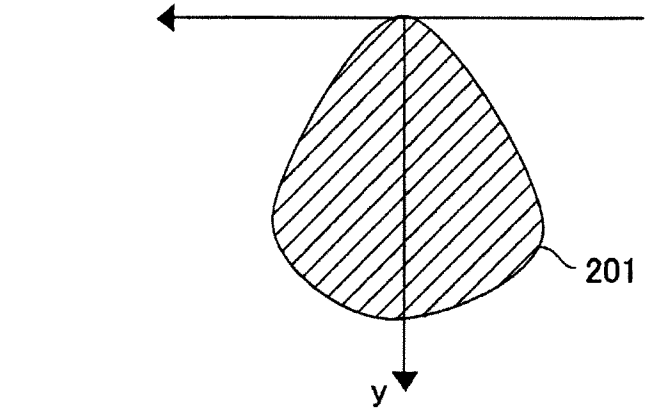
FIGS. 10A to 10D are graphs showing a main beam radiation pattern in a horizontal plane (x-y plane) in each of the mobile communication base station antennas 20*a*, 20*b;*
Figure 10B:
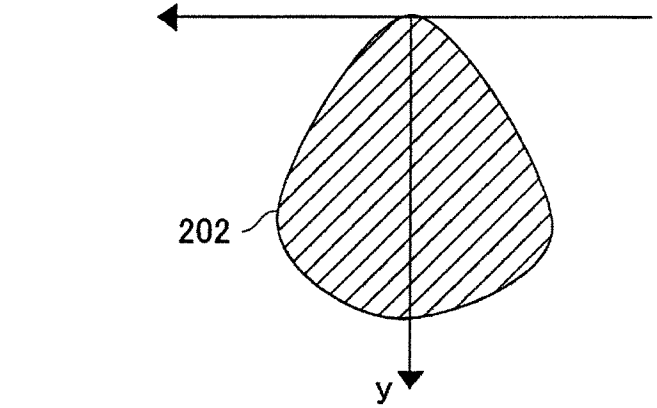
Figure 10C:
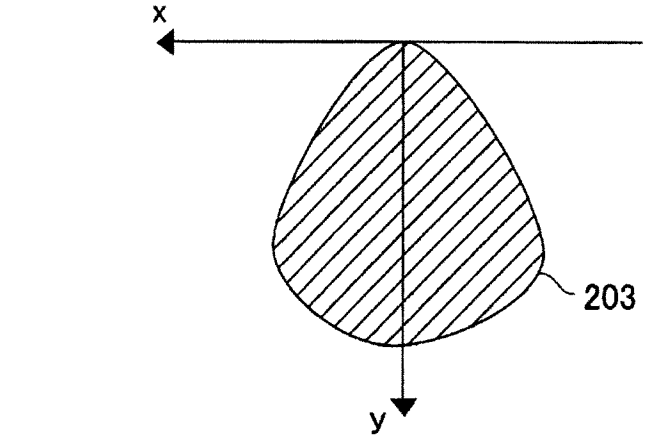
Figure 10D:
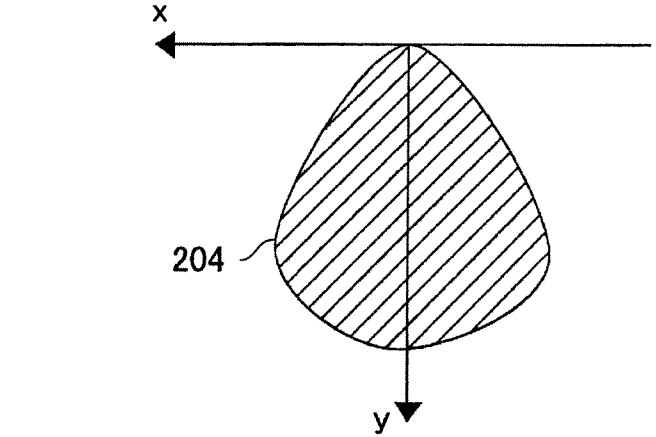

FIG. 10A shows a main beam radiation pattern 201 in the case of the structure shown in FIG. 9A. FIG. 10B shows a main beam radiation pattern 202 in the case of the structure shown in FIG. 9B. FIG. 10C shows a main beam radiation pattern 203 in the case of the structure shown in FIG. 9C. FIG. 10D shows a main beam radiation pattern 204 in the case of the structure shown in FIG. 9D.

In all cases, the horizontal plane main beams 201, 202, 203 and 204 are oriented toward the antenna front direction (the y-direction). It is because that the power is supplied equally to the two array antennas 21*a* and 21*b*, so that the radiation conductor structure in the horizontal plane is substantially symmetrical with respect to the antenna front direction (the y-direction).

In the case of the mobile communication base station antenna 20*a* shown in FIG. 9A, the power supplied from the first feeding port 27-1 is divided by the power divider 28 and distributed to four vertical polarized wave antenna elements 25*a* at the upper half part via one wiring system 29 and to four vertical polarized wave antenna elements 25*b* at the lower half part via the other wiring system 29.

In the case of the mobile communication base station antenna 20*b* shown in FIG. 9B, the power supplied from the second feeding port 27-2 is divided by the power divider 28 and distributed to four vertical polarized wave antenna elements 25*a* at the lower half part via one wiring system 29 and to four vertical polarized wave antenna elements 25*b* at the upper half part via the other wiring system 29.

In the case of the mobile communication base station antenna 20*a* shown in FIG. 9C, the power supplied from the first feeding port 27-1 is divided by the power divider 28 and distributed to four horizontal polarized wave antenna elements 24*a* at the upper half part via one wiring system 29 and to four horizontal polarized wave antenna elements 24*b* at the lower half part via the other wiring system 29.

In the case of the mobile communication base station antenna 20*b* shown in FIG. 9D, the power supplied from the second feeding port 27-2 is divided by the power divider 28 and distributed to four horizontal polarized wave antenna elements 24*a* at the lower half part via one wiring system 29 and to four horizontal polarized wave antenna elements 24*b* at the upper half part via the other wiring system 29.

As to FIGS. 9A to 9D, the vertical polarized wave antenna elements 25*a* and 25*b* are shown in FIGS. 9A and 9B, and the horizontal polarized wave antenna elements 24*a* and 24*b* are shown in FIGS. 9C and 9D. However, the vertical polarized wave antenna elements 25*a* and 25*b* are combined with the horizontal polarized wave antenna elements 24*a* and 24*b*, respectively to provide the antenna element pairs 14 explained in the first preferred embodiment. In practice, the mobile communication base station antenna 20*a* as one power feeding system comprises the vertical polarized wave antenna elements 25*a* and 25*b* shown in FIG. 9A that are combined with the horizontal polarized wave antenna elements 24*a* and 24*b* shown in FIG. 9C. In the meantime, the mobile communication base station antenna 20*b* as the other power feeding system comprises the vertical polarized wave antenna elements 25*a* and 25*b* shown in FIG. 9B that are combined with the horizontal polarized wave antenna elements 24*a* and 24*b* shown in FIG. 9D.

In the second preferred embodiment, it is intended to minimize the adjacent arrangement of the antenna elements 24, 25 to which the power is supplied from the different power feeding ports 27-1, 27-2, for the vertical polarized wave antenna elements 25*a*, 25*b* and the horizontal polarized wave antenna elements 24*a*, 24*b* that are juxtaposed and adjacent to each other in the first and second array antennas 21*a* and 21*b* in the mobile communication base station antenna 20. In combination with the function and the effect of a shield plate 22, it is possible to improve the isolation between the two adjacent array antennas 21*a* and 21*b* more effectively.

Further, similarly to the first preferred embodiment, according to the second preferred embodiment, the power is dispersively distributed to the two array antennas 21*a* and 21*b* from the first feeding port 27-1 and the power is also dispersively distributed to the two array antennas 21*a* and 21*b* from the second feeding port 27-2. As a result, the bias (imbalance) in the power feeding from the respective feeding ports 27-1, 27-2 can be calibrated, so that it is possible to reduce the tilt of the horizontal plane main beams radiated from the first and second array antennas 11*a*, 11*b* with respect to the antenna front direction, and it is possible to suppress the deterioration of the antenna characteristics.

Figure 11A:
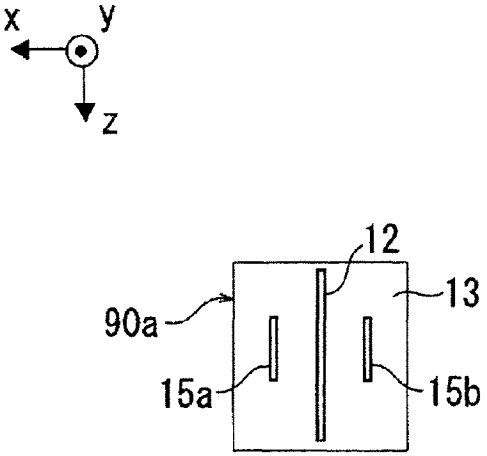
FIGS. 11A to 11D are schematic diagrams showing an example in which one shield plate 12 is provided and an example in which two shield plates 12 are provided.
Figure 11B:
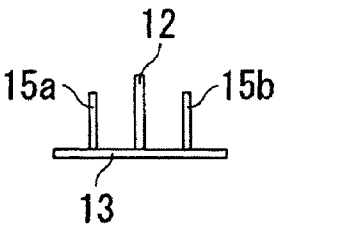
Figure 11C:
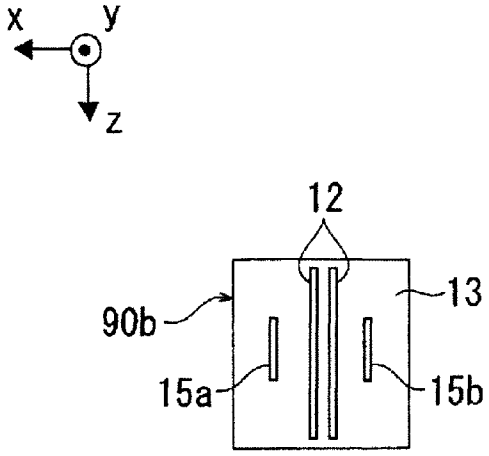
Figure 11D:
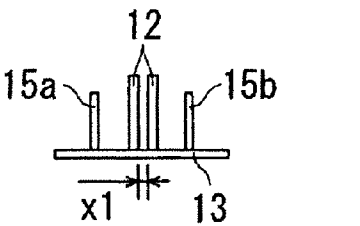

FIGS. 11A and 11B are schematic diagrams showing a mobile communication base station antenna 90*a* with a single shield plate 12, and FIGS. 11C and 11D are schematic diagrams showing a mobile communication base station antenna 90*b* with two shield plates 12.

In the first preferred embodiment, the example in which the single shield plate 12 is provided between two array antennas 11*a*, 11*b*. The present invention is not limited thereto. Plural (e.g. two) shield plates 12 may be juxtaposed in the horizontal direction. According to this structure, the isolation between the two array antennas 11*a*, 11*b* can be further improved by juxtaposing two shield plates 12 in the horizontal direction.

Next, the function and effect of arranging the two shield plates 12 will be described below in more detail. For the purpose of simplifying the explanation, a model, in which the horizontal polarized wave antenna elements 16 are omitted and only the vertical polarized wave antenna elements 15*a*, 15*b* are provided, is used instead of the antenna element pairs 14, each of which is formed by combining a pair of the vertical polarized wave antenna element 15 and the horizontal polarized wave antenna element 16 to be perpendicular to each other.

The mobile communication base station antenna 90*a*, referring to the front view thereof in FIG. 11A and the plan view there of in FIG. 11B, comprises one shield plate 12, and further comprises a vertical polarized wave antenna element 15*a* connected to a feeding port (not shown), a vertical polarized wave antenna element 15*b* connected to a 50-ohm terminal, and a reflective plate 13. The reflective plate 13 and the shield plate 20 are electrically connected to each other.

On the other hand, the mobile communication base station antenna 90*b*, referring to the front view thereof in FIG. 11C and the plan view there of in FIG. 11D, comprises two shield plates 12 that are juxtaposed with a predetermined interval X1, and further comprises, similarly to the mobile communication base station antenna 90*a*, a vertical polarized wave antenna element 15*a* connected to a feeding port (not shown), a vertical polarized wave antenna element 15*b* connected to a 50-ohm terminal, and a reflective plate 13. The reflective plate 13 and the shield plates 12 are electrically connected to each other.

A simulation result of the electromagnetic coupling quantity between the vertical polarized wave antenna element 15*a* and the vertical polarized wave antenna element 15*b* in the mobile communication base station antenna 90*a* was −27.1 dB. On the other hand, a simulation result of the electromagnetic coupling quantity between the vertical polarized wave antenna element 15*a* and the vertical polarized wave antenna element 15*b* in the mobile communication base station antenna 90*b* was −29.2 dB.

Therefore, it is possible to improve the isolation between the vertical polarized wave antenna elements 15*a* and 15*b* more effectively by providing two shield plates 12 between the adjacent vertical polarized wave antenna elements 15*a* and 15*b*.

Further, by providing the two shield plates 12 with the predetermined interval X1 between the adjacent vertical polarized wave antenna elements 15*a* and 15*b* instead of the single shield plate 12, it is possible to solve the problem in the conventional mobile communication base station antenna, namely, the antenna characteristics such as the directivity is deteriorated due to the forcible decrease in the distance between the vertical polarized wave antenna elements 15*a* and 15*b* for avoiding the increase in the installation occupied area.

The configuration of arranging the plural shield plates 12 is applicable to the first and second preferred embodiments, and also applicable to respective preferred embodiments to be explained below.

Third Preferred Embodiment

Figure 12B:
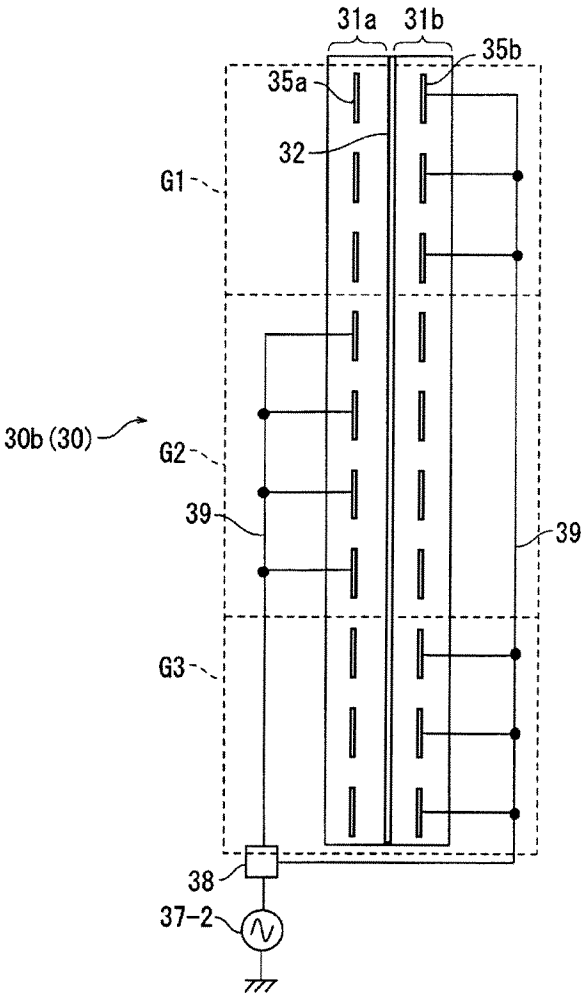
FIGS. 12A and 12B are schematic diagrams showing a mobile communication base station antenna 30 (30*a*, 30*b*) in the third preferred embodiment according to the invention.
Figure 12A:
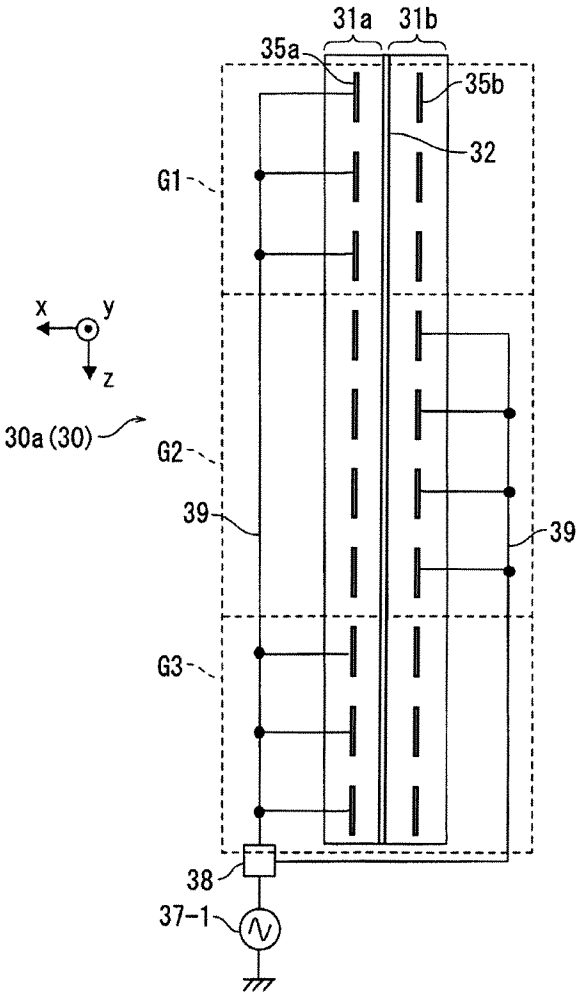

FIGS. 12A and 12B are schematic diagrams showing a mobile communication base station antenna 30 (30*a*, 30*b*) in the third preferred embodiment according to the invention The mobile communication base station antenna 30 comprises a first feeding port 37-1 and a second feeding port 37-2 for feeding the power to a first array antenna 31*a* and a second array antenna 31*b*.

Referring to FIG. 12A, the first feeding port 37-1 is connected to the first, second and third, eighth, ninth and tenth antenna elements 35*a* of the first array antenna 31*a* and the fourth, fifth, sixth and seventh antenna elements 35*b* of the second array antenna 31*b*.

On the other hand, referring to FIG. 12B, the second feeding port 37-2 is connected to the fourth, fifth, sixth and seventh antenna elements 35*a* of the first array antenna 31*a* and the first, second and third, eighth, ninth and tenth antenna elements 35*b* of the second array antenna 31*b*.

Herein, the antenna elements 35 (35*a*, 35*b*) are divided into the first, second and third groups G1, G2 and G3, each of which includes at least two antenna elements 35, in the order from the upper side to the lower side in the vertical direction (the z-direction in FIGS. 12A and 12B).

In other words, the antenna elements 35 are divided into a first group to an Nth group (N is an integer which is equal to or more than 3).

Referring to FIG. 12A, the first feeding port 37-1 is connected to the antenna elements 35*a* of the odd number groups (the first group G1 and the third group G3) of the first array antenna 31*a* and the antenna elements 35*b* of the even number group (the second group G2) of the second array antenna 31*b*.

On the other hand, referring to FIG. 12B, the second feeding port 37-2 is connected to the antenna elements 35*a* of the even number group (the second group G2) of the first array antenna 31*a* and the antenna elements 35*b* of the odd number groups (the first group G1 and the third group G3) of the second array antenna 31*b*.

Herein, the odd number group is a group of the antenna elements divided into plural groups, which is located at the odd-numbered position, e.g. the first, third, fifth . . . groups. The even number group is a group of the antenna elements divided into plural groups, which is located at the even-numbered position, e.g. the second, fourth, sixth . . . groups.

In the third preferred embodiment, ten antenna elements 35 are disposed along the vertical direction, and three antenna elements, four antenna elements and three antenna elements in the order form the upper side to the lower side in the vertical direction are alternately connected to the two different feeding ports 37-1 and 37-2 (10-elements: 3-4-3 distribution).

(Angle of the Mobile Communication Base Station Antenna)

Next, a definition of the angle of the mobile communication base station antenna 30 will be explained below.

Figure 13:
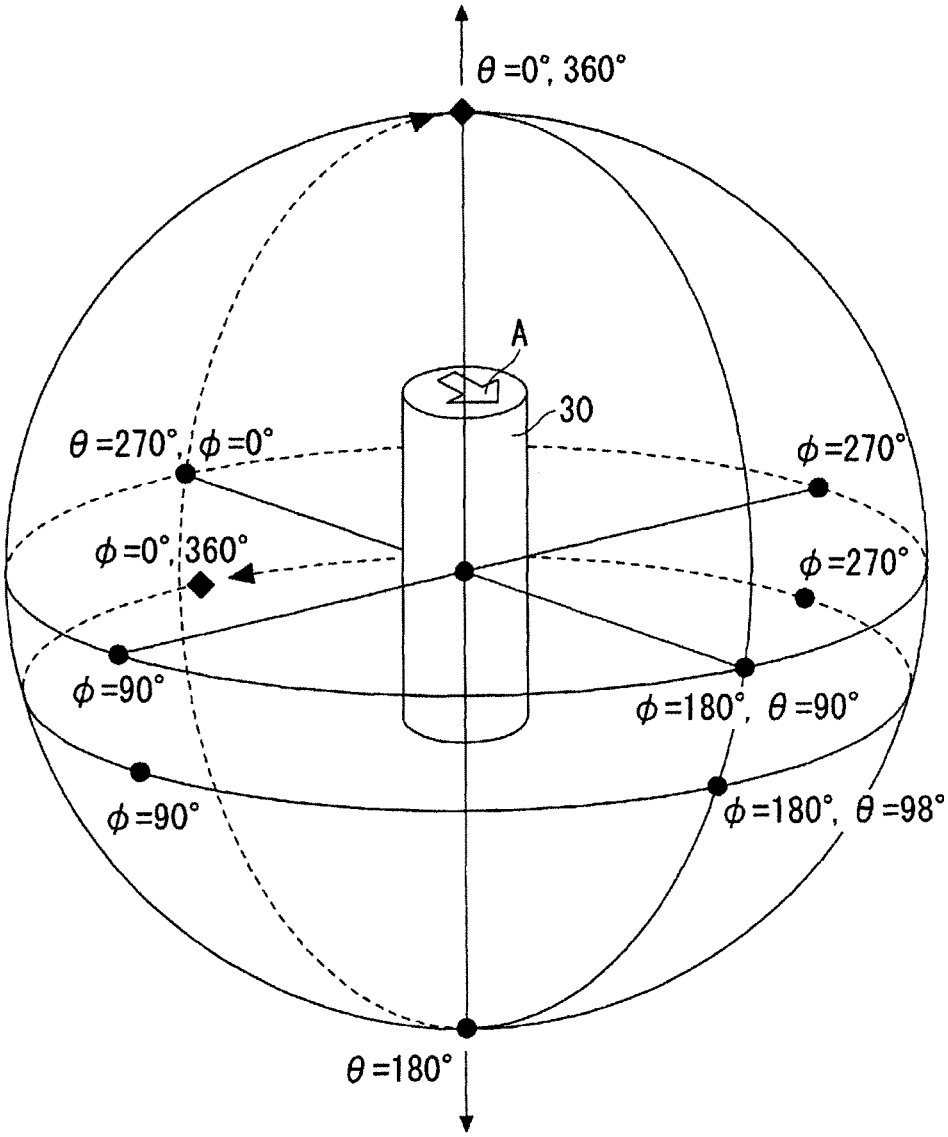
FIG. 13 is an explanatory diagram for explaining a definition of an antenna angle of the mobile communication base station antenna.

FIG. 13 is an explanatory diagram for explaining a definition of an antenna angle of the mobile communication base station antenna 30.

Referring to FIG. 13, a vertical angle θ is a parameter for indicating an angle in the vertical direction of the mobile communication base station antenna 30. With respect to a center axis of the mobile communication antenna 30, the vertical angle θ is 0° (θ=0°) at a zenith (a vertical point), 90° (θ=90°) at a front direction (the direction indicated by an arrow A), 180° (θ=180°) at a lowermost position (rotated in the clockwise direction from the front direction), 270° (θ=270°) at a back direction (rotated in the clockwise direction from the lowermost position), and 360° (θ=360°) at the zenith. The vertical angle θ of 360° (θ=360°) means the same position as the vertical angle θ of 0° (θ=0°).

On the other hand, a horizontal angle ϕ is a parameter for indicating an angle in the horizontal direction of the mobile communication base station antenna. With respect to the back direction (i.e. the direction opposite to the front direction indicated by an arrow A) of the mobile communication antenna 30 as a center, the horizontal angle ϕ is 0° (ϕ=0°) at the back direction, 90° (ϕ=90°) at a right hand direction (rotated in the counterclockwise direction from the back direction) of the mobile communication antenna 30, 180° (ϕ=180°) at the front direction (rotated in the counterclockwise direction from the right hand direction) of the mobile communication base station antenna 30, 270° (ϕ=270°) at a left hand direction (rotated in the counterclockwise direction from the front direction) of the mobile communication base station antenna 30, and 360° (ϕ=360°) at the back direction (rotated in the counterclockwise direction from the left hand direction) of the mobile communication base station antenna 30. The horizontal angle θ of 360° (ϕ=360°) means the same position as the horizontal angle ϕ of 0° (ϕ=0°).

For example, the vertical plane directivity at a plane where the horizontal angle ϕ is 0° (ϕ=0°) can be confirmed by examining a beam shape radiated from the mobile communication base station antenna 30 at a cross section of a spherical body shown in FIG. 13, which is vertically cut along the plane where the horizontal angle ϕ is 0° (ϕ=0°). Similarly, the vertical plane directivity at a plane where the horizontal angle ϕ is 98° (ϕ=98°) can be confirmed by examining a beam shape radiated from the mobile communication base station antenna 30 at a cross section of the spherical body shown in FIG. 13, which is vertically cut along the plane where the horizontal angle ϕ is 98° (ϕ=98°).

(Horizontal Plane Directivity of the Mobile Communication Base Station Antenna)

Next, the horizontal plane directivity of the mobile communication base station antenna 30 will be explained below.

Figure 14:
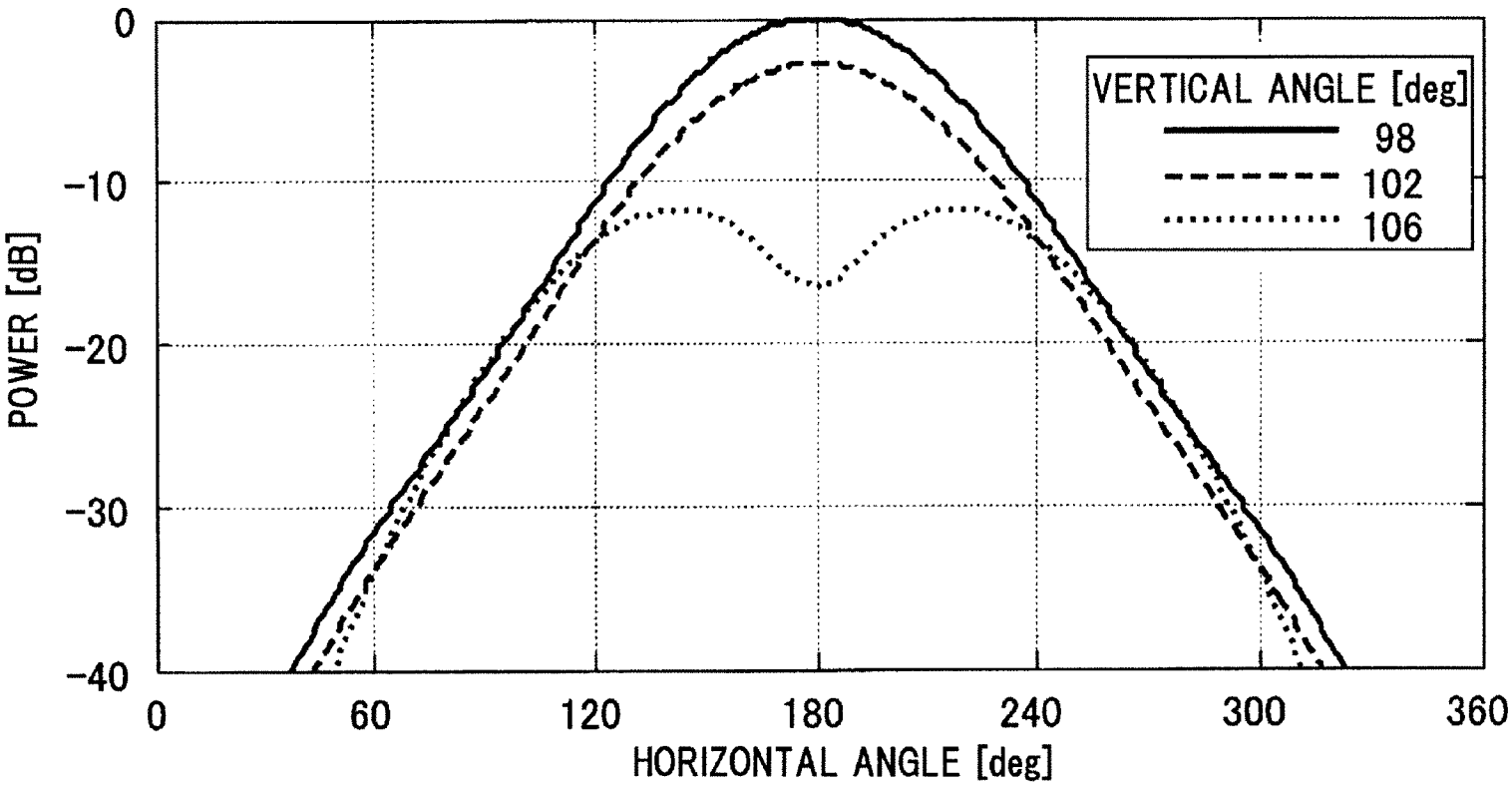
FIG. 14 is a graph showing a horizontal plane directivity of the mobile communication base station antenna 30 in the third preferred embodiment according to the invention.

FIG. 14 is a graph showing a horizontal plane directivity of the mobile communication base station antenna 30 in the third preferred embodiment according to the invention. FIG. 14 shows the relationship between the power at predetermined vertical angles and a horizontal angle. In FIG. 14, a vertical axis indicates the power [dB] and a horizontal axis indicates a horizontal angle [deg]. Further, in FIG. 14, a solid line shows that the vertical angle is 98° [deg], a broken line shows that the vertical angle is 102° [deg], and a dashed line shows that the vertical angle is 106° [deg]. The above relationship and definitions are the same in graphs described below.

According to the antenna element arrangement of the array antennas 31 in the mobile communication base station antenna 30, horizontal plane directivities as shown in FIG. 14 are obtained. The maximum radiation direction is a direction of (horizontal angle ϕ, vertical angle θ)=(180°, 98°), and tilted with an angle of 8° toward the earth side from the horizontal direction.

Herein, the radiation electromagnetic field of the antenna has the direction characteristics that are inherent to each antenna, which is called as the radiation directivity or the radiation pattern characteristic. Among the antenna directivities, the "main lobe" (the main beam) is the lobe (beam) in the maximum radiation direction and the vicinity thereof, and the other lobes (beams) are called as the "side lobes" (the sub beams). Namely, the side lobe is the lobe generated in the other directions than the main beam direction in the antenna radiation pattern. In the present preferred embodiment, the main beam is the lobe at the vertical angle θ of 98° (θ=98°), while the side lobes are the lobes in the other parts than the vertical angle θ of 98°, i.e. the lobes at the vertical angle θ of 102° and 106° (θ=102° and 106°). In the present preferred embodiment, the bilateral symmetry of the beam is also excellent in horizontal planes (cut plane θ=102° and 106°) other than a horizontal plane (cut plane θ=98°) including the maximum radiation direction (i.e. the direction in which intensity of transmit signal and receive signal are maximum).

As described above, according to the mobile communication base station antenna 30 in the third preferred embodiment, it is possible to provide the mobile communication base station antenna by which not only the main beam but also the side lobes are radiated with a good balance toward the antenna front direction.

Accordingly, it was confirmed that the horizontal plane directivity with the good bilateral balance will be obtained, if the number of the antenna elements in the first group G1 is set to be equal to the number of the antenna elements in the third group G3 (in the present preferred embodiment, the number of the antenna elements included in one array antenna is three for the first and third groups G1 and G3, respectively). The present preferred embodiment is explained by using the element arrangement of 10-elements; 3-4-3 distribution as an example. However, the present invention is not limited thereto. The similar effect can be obtained by using the element arrangement of 8-elements; 2-4-2 distribution, 7-elements; 2-3-2 distribution, or the like.

Fourth Preferred Embodiment

Figure 15B:
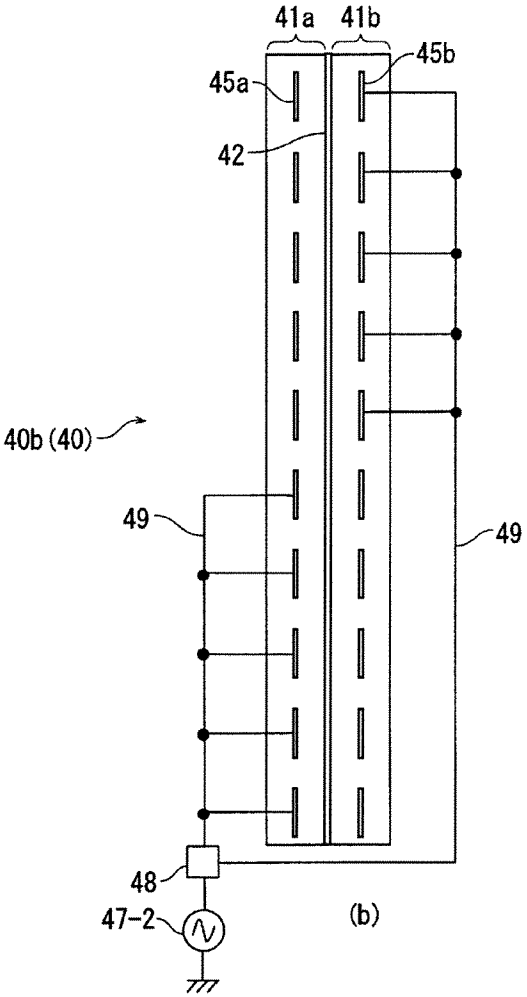
FIGS. 15A and 15B are schematic diagrams showing a mobile communication base station antenna 40 (40*a*, 40*b*) in the fourth preferred embodiment according to the invention.
Figure 15A:
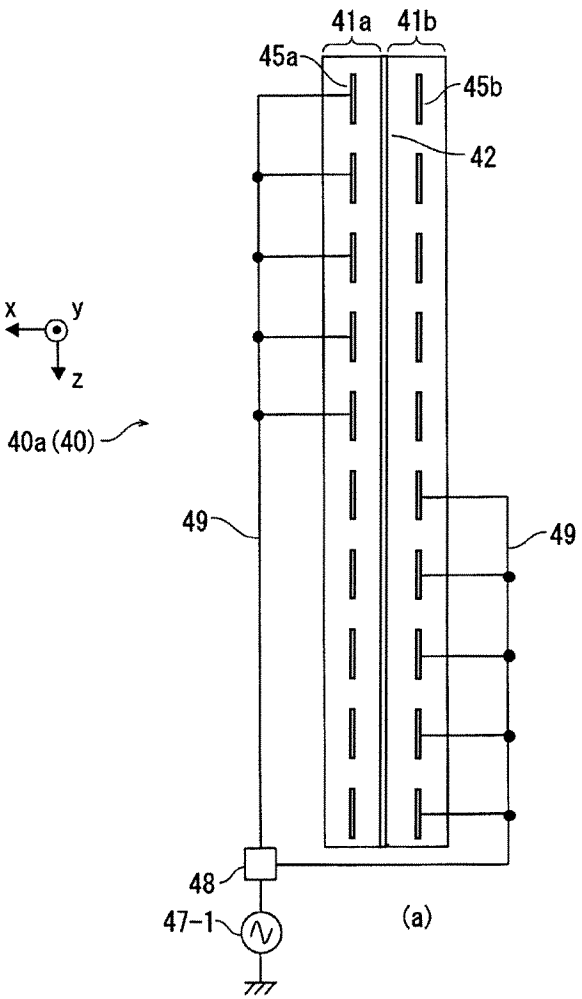

FIGS. 15A and 15B are schematic diagrams showing a mobile communication base station antenna 40 (40*a*, 40*b*) in the fourth preferred embodiment according to the invention.

The mobile communication base station antenna 40 comprises a first feeding port 47-1 and a second feeding port 47-2 for feeding the power to a first array antenna 41*a* and a second array antenna 41*b*.

Referring to FIG. 15A, the first feeding port 47-1 is connected to the first, second and third, fourth and fifth antenna elements 45*a* of the first array antenna 41*a* and the sixth, seventh, eighth, ninth and tenth antenna elements 45*b* of the second array antenna 41*b*.

On the other hand, referring to FIG. 15B, the second feeding port 47-2 is connected to the sixth, seventh, eighth, ninth and tenth antenna elements 45*a* of the first array antenna 41*a* and the first, second and third, fourth and fifth antenna elements 45*b* of the second array antenna 41*b*.

In the fourth preferred embodiment, ten antenna elements 45 are disposed along the vertical direction, and five antenna elements 45 and five antenna elements 45 in the order from the upper side to the lower side in the vertical direction are alternately connected to the two different feeding ports 47-1 and 47-2 (10-elements: 5-5 distribution).

Figure 16:
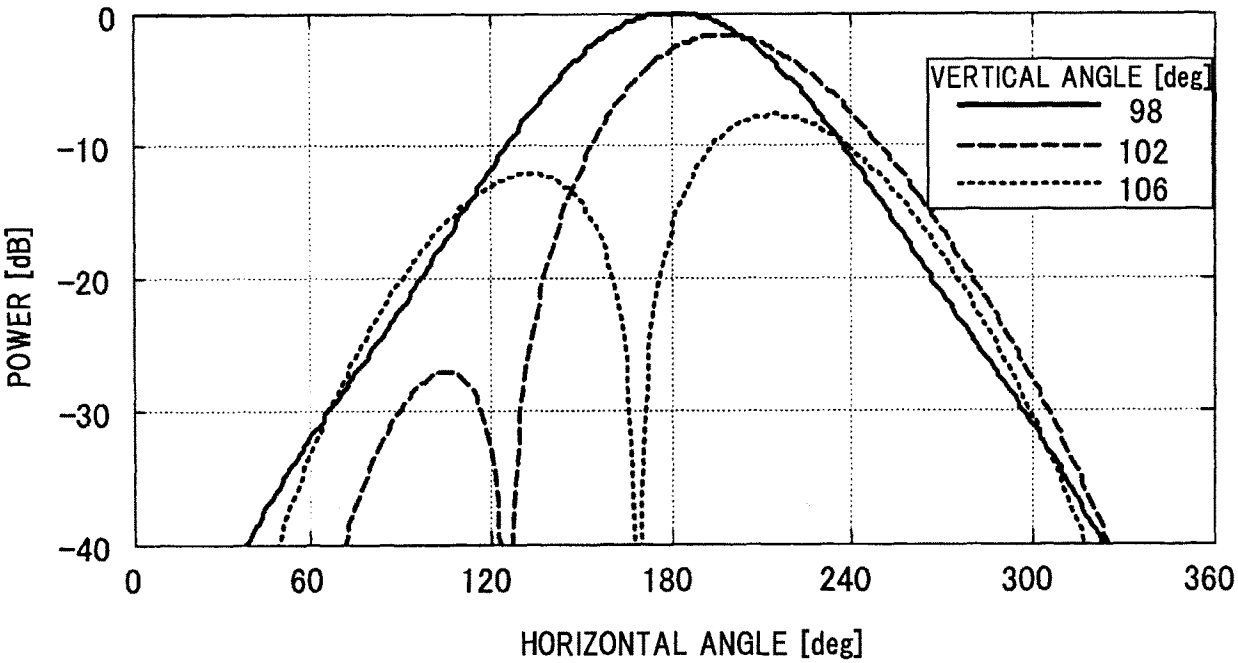
FIG. 16 is a diagram showing a horizontal plane directivity of the mobile communication base station antenna 40 in the fourth preferred embodiment according to the invention.

FIG. 16 is a graph showing a horizontal plane directivity of the mobile communication base station antenna 40 in the fourth preferred embodiment according to the invention. According to element arrangement of the array antenna in the mobile communication base station antenna 40 shown in FIGS. 15A and 15B, horizontal plane directivities as shown in FIG. 16 are obtained. The maximum radiation direction is a direction of (horizontal angle $\phi$, vertical angle $\theta$)=(180°, 98°), and tilted with an angle of 8° toward the earth side from the horizontal direction. In the present preferred embodiment, the bilateral symmetry of the beam in the horizontal plane including the maximum radiation direction (cut plane $\theta$=98°) is excellent, while the bilateral symmetry of the beam is not good in the other horizontal planes (cut plane $\theta$=102° and 106°).

As described above, according to the mobile communication base station antenna 40 in the fourth preferred embodiment, it is possible to provide the mobile communication base station antenna, by which the side lobes cannot be radiated toward the antenna front direction with the good balance but the bilateral symmetry of the main beam can be improved.

Fifth Preferred Embodiment

Figure 17B:
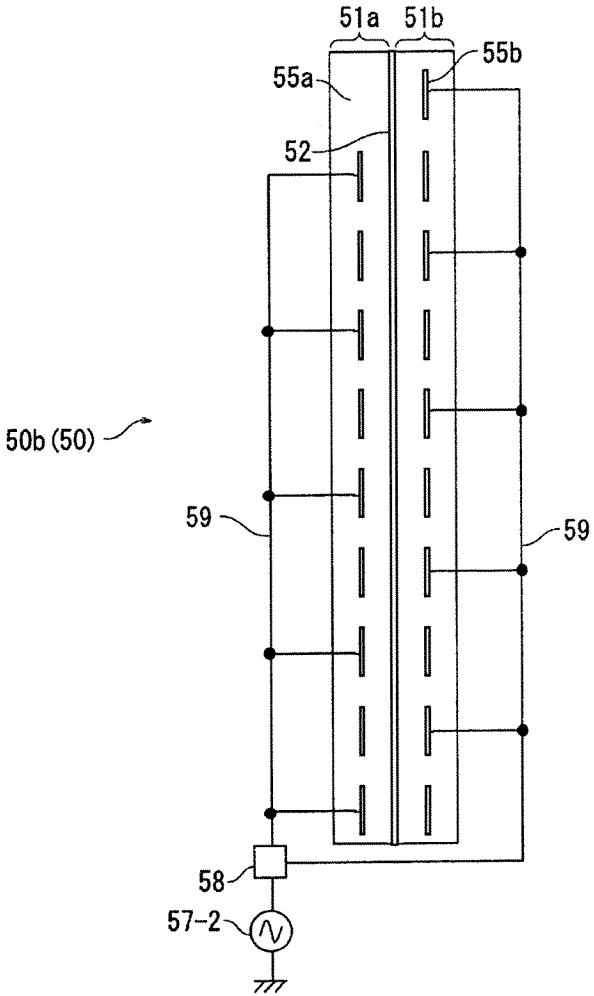
FIGS. 17A and 17B are schematic diagrams showing a mobile communication base station antenna 50 (50*a*, 50*b*) in the fifth preferred embodiment according to the invention.
Figure 17A:
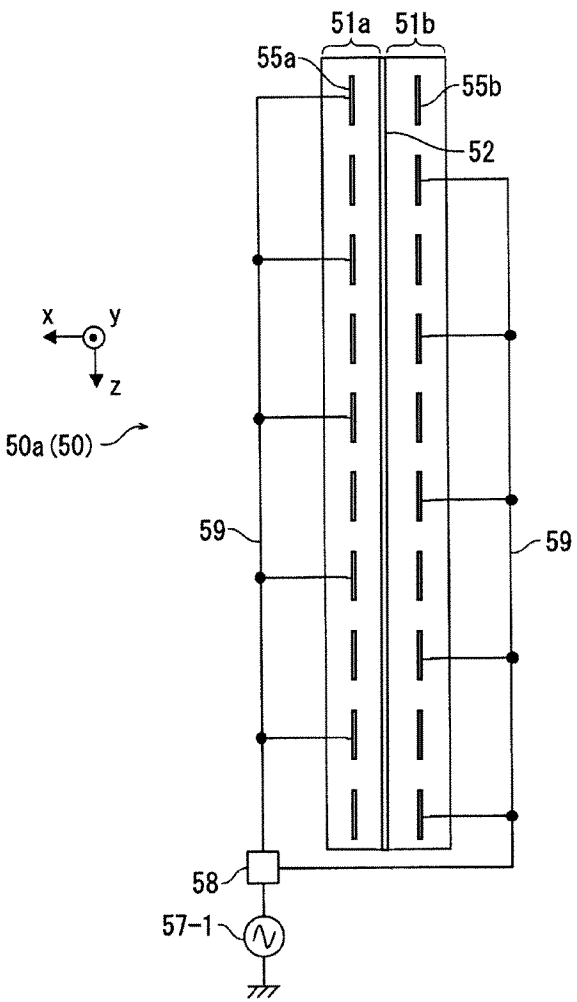

FIGS. 17A and 17B are schematic diagrams showing a mobile communication base station antenna 50 (50*a*, 50*b*) in the fifth preferred embodiment according to the invention.

The mobile communication base station antenna 50 comprises a first feeding port 57-1 and a second feeding port 57-2 for feeding the power to a first array antenna 51*a* and a second array antenna 51*b*.

Referring to FIG. 17A, the first feeding port 57-1 is connected to the first, third and fifth, seventh, and ninth (the odd number) antenna elements 55*a* of the first array antenna 51*a* and the second, fourth, sixth, eighth and tenth antenna (the even number) elements 55*b* of the second array antenna 51*b*.

On the other hand, referring to FIG. 17B, the second feeding port 57-2 is connected to the second, fourth, sixth, eighth and tenth antenna (the even number) elements 55*a* of the first array antenna 51*a* and the first, third and fifth, seventh, and ninth (the odd number) antenna elements 55*b* of the second array antenna 51*b*.

In the fifth preferred embodiment, ten antenna elements 55 are disposed along the vertical direction, and the antenna elements 55 are connected one by one alternately in the order from the upper side to the lower side in the vertical direction to the two different feeding ports 57-1 and 57-2 (10-elements: 5-5 distribution).

Figure 18:
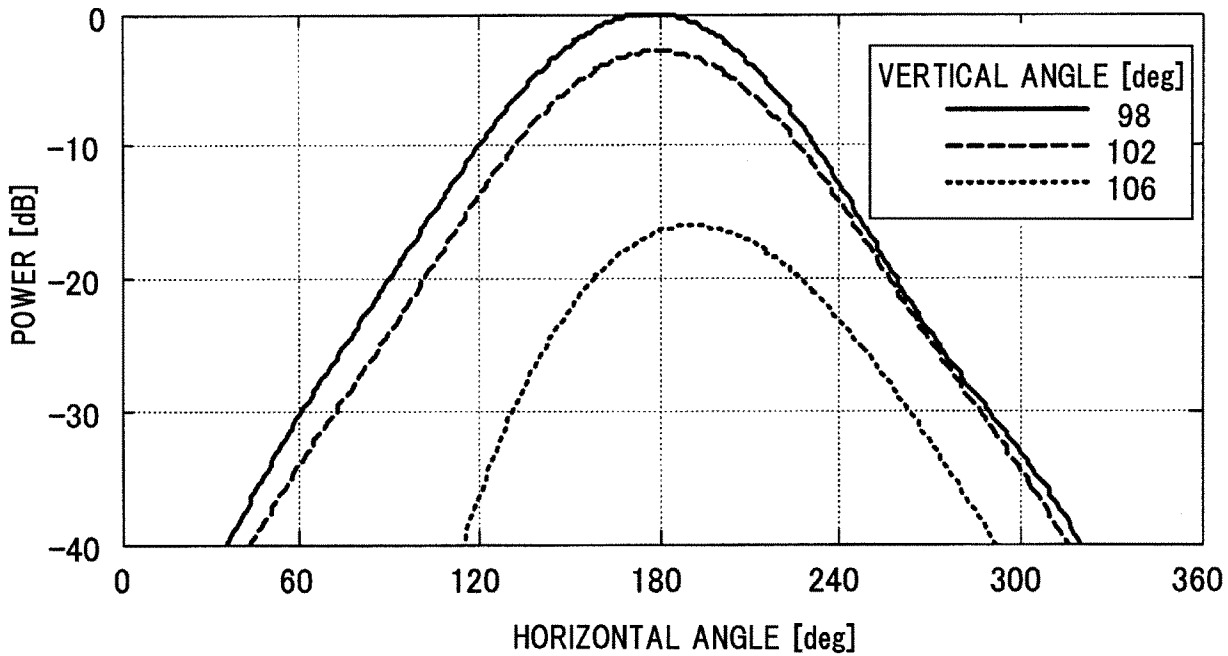
FIG. 18 is a diagram showing a horizontal plane directivity of the mobile communication base station antenna 50 in the fifth preferred embodiment according to the invention.

FIG. 18 is a graph showing a horizontal plane directivity of the mobile communication base station antenna 50 in the fifth preferred embodiment according to the invention. According to the antenna element arrangement of the array antenna in the mobile communication base station antenna 50 shown in FIGS. 17A and 17B, horizontal plane directivities as shown in FIG. 18 are obtained. In the present preferred embodiment, the bilateral symmetry of the beam in the horizontal plane including the maximum radiation direction (cut plane $\theta$=98°) is excellent, while the waveform of the beam is shifted toward the right side in the other horizontal plane, particularly at the cut plane $\theta$ of 106° ($\theta$=106°), so that the bilateral symmetry of the beam is slightly deteriorated.

As described above, according to the mobile communication base station antenna 50 in the fifth preferred embodiment, it is possible to provide the mobile communication base station antenna, by which the side lobes cannot be radiated toward the antenna front direction with the good balance but the bilateral symmetry of the main beam can be improved, and the main beam can be radiated toward the antenna front direction with the good balance.

Sixth Preferred Embodiment

Figure 19B:
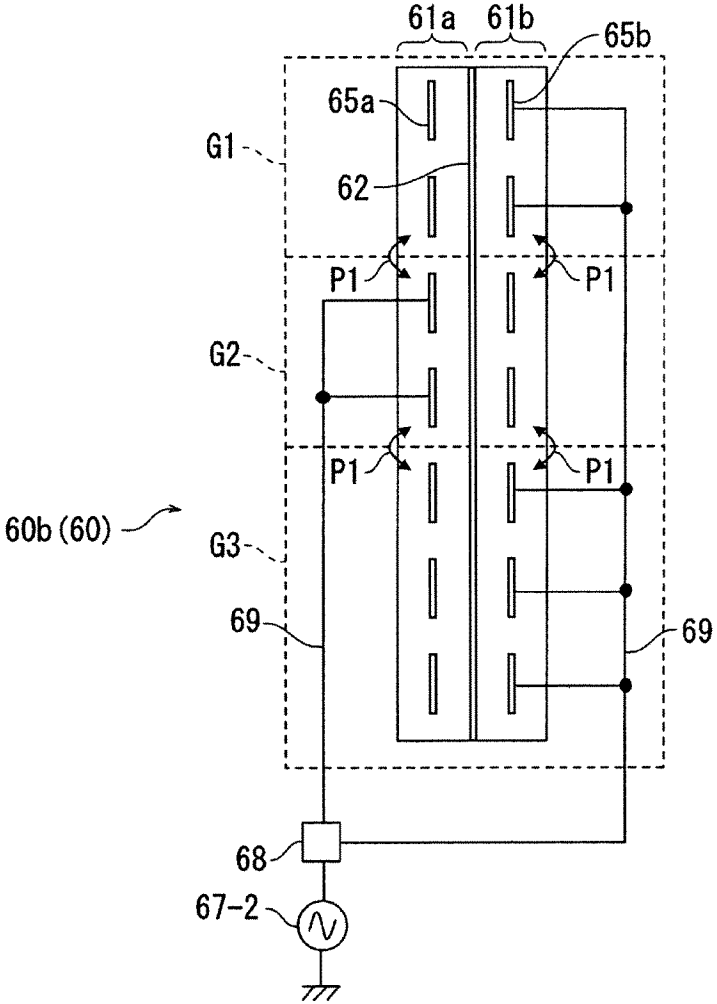
FIGS. 19A and 19B are schematic diagrams showing a mobile communication base station antenna 60 (60*a*, 60*b*) in the sixth preferred embodiment according to the invention.
Figure 19A:
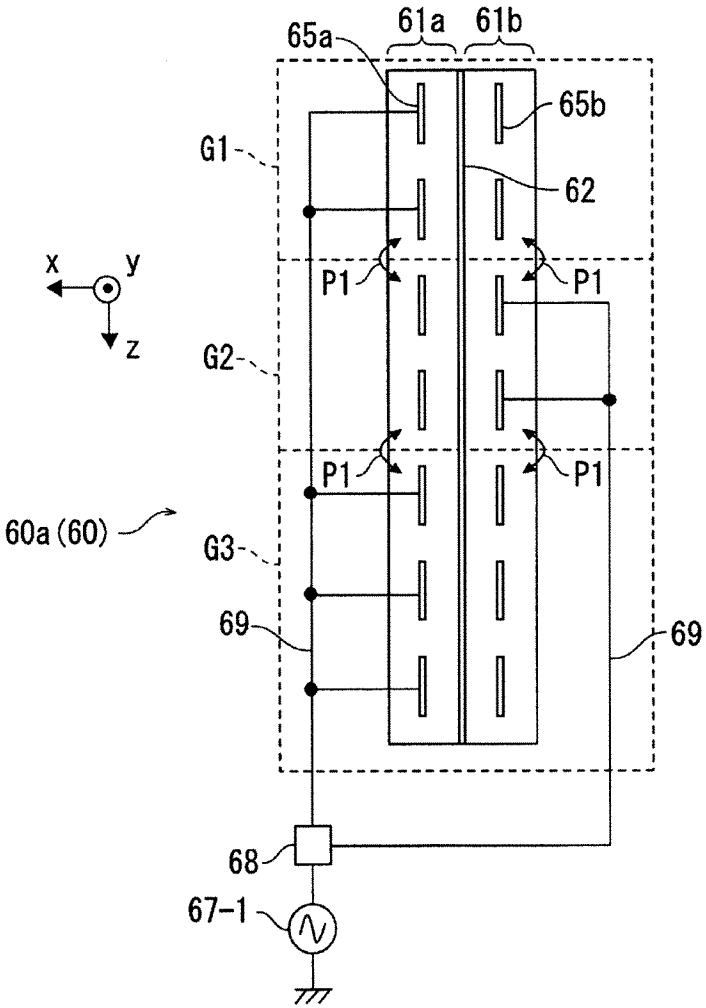

FIGS. 19A and 19B are schematic diagrams showing a mobile communication base station antenna 60 (60*a*, 60*b*) in the sixth preferred embodiment according to the invention The mobile communication base station antenna 60 comprises a first feeding port 67-1 and a second feeding port 67-2 for feeding the power to a first array antenna 61*a* and a second array antenna 61*b*.

Referring to FIG. 19A, the first feeding port 67-1 is connected to the first, second and fifth, sixth, and seventh antenna elements 65*a* of the first array antenna 61*a* and the third and fourth antenna elements 65*b* of the second array antenna 61*b*.

On the other hand, referring to FIG. 19B, the second feeding port 67-2 is connected to the third and fourth antenna elements 65*a* of the first array antenna 61*a* and the first, second, fifth, sixth and seventh antenna elements 65*b* of the second array antenna 61*b*.

Referring to FIG. 19A, the first feeding port 67-1 is connected to the antenna elements 65*a* of the odd number groups (the first group G1 and the third group G3) of the first array antenna 61*a* and the antenna elements 65*b* of the even number group (the second group G2) of the second array antenna 61*b*.

On the other hand, referring to FIG. 19B, the second feeding port 67-2 is connected to the antenna elements 65*a* of the even number group (the second group G2) of the first array antenna 61*a* and the antenna elements 65*b* of the odd number groups (the first group G1 and the third group G3) of the second array antenna 61*b*.

In the sixth preferred embodiment, seven antenna elements 65 are disposed along the vertical direction, and two antenna elements 65, two antenna elements 65, and three antenna elements 65 in the order from the upper side to the lower side in the vertical direction are connected alternately to the two different feeding ports 67-1 and 67-2 (7-elements: 2-2-3 distribution).

In the sixth preferred embodiment, the number of the antenna elements 65 in each array antenna 61 is seven, and a power divider 68 is adjusted such that a ratio of the power distributed to the respective antenna elements 65 (from the upper side to the lower side in FIGS. 19A and 19B) is 5:20:25:25:15:5:5, when the total power is 100.

Herein, the antenna elements 65 in each array antenna 61 is divided into three groups (i.e. the first, second and third groups G1, G2 and G3 in the order from the upper side to the lower side in FIGS. 19A and 19B).

A ratio of the sums of the powers distributed to the respective groups G1, G2 and G3 is expressed as follows:

$$\begin{aligned} G1:G2:G3 &= (5+20):(25+25):(15+5+5) \\ &= 25:50:25 \\ &= 1:2:1. \end{aligned}$$

Since the radiation power of each antenna element is proportional to the power supplied to each antenna element, a ratio of the radiation power of the respective groups G1, G2 and G3 is also expressed as:

G1:G2:G3=1:2:1.

A ratio of the sums of the powers distributed to the first and second array antennas 61*a* and 61*b* is expressed as follows:

$$\begin{aligned} &(\text{The first array antenna } 61a):(\text{The second array antenna } 61b) = \\ &\qquad (5+20+15+5+5):(25+25) = 50:50 = 1:1. \end{aligned}$$

Since the radiation power of each antenna element is proportional to the power supplied to each antenna element, a ratio of the radiation power of the first and second array antennas 61*a* and 61*b* is also expressed as:

(The first array antenna 61*a*):(The second array antenna 61*b*)=1:1.

In this case, the number of combinations of one antenna element connected to one feeding port and its adjacent antenna element connected to the other feeding port (i.e. the number of pairs of the adjacent antenna elements connected to the different feeding ports 67-1 and 67-2 in FIGS. 19A and 19B) is four, referring to the combinations indicated by an arrow P1.

Figure 20:
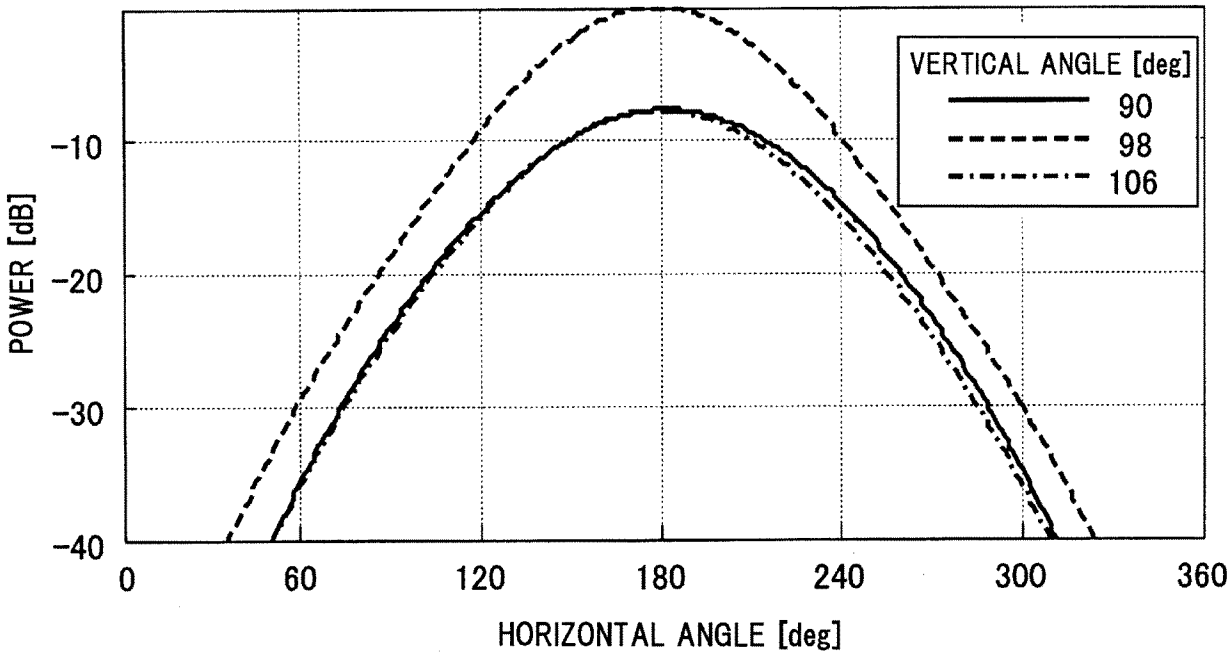
FIG. 20 is a diagram showing a horizontal plane directivity of the mobile communication base station antenna in the sixth preferred embodiment according to the invention.

FIG. 20 is a graph showing a horizontal plane directivity of the mobile communication base station antenna 60 in the sixth preferred embodiment according to the invention. In FIG. 20, a solid line shows that the vertical angle is 90° [deg], a broken line shows that the vertical angle is 98° [deg], and a dashed line shows that the vertical angle is 106° [deg]. The above relationship and definitions are the same in graphs described below.

According to the antenna element arrangement of the array antenna in the mobile communication base station antenna 60 shown in FIGS. 19A and 19B, horizontal plane directivities as shown in FIG. 20 are obtained. The maximum radiation direction is a direction of (horizontal angle $\phi$, vertical angle $\theta$)=(180°, 98°), and tilted with an angle of 8° toward the earth side from the horizontal direction. In the present preferred embodiment, the bilateral symmetry of the beam is also excellent in horizontal planes (cut plane $\theta$=90° and 106°) other than a horizontal plane (cut plane $\theta$=98°) including the maximum radiation direction.

According to the antenna element arrangement in the sixth preferred embodiment, the number of the combinations of one antenna element connected to one feeding port and its adjacent antenna element connected to the other feeding port is small i.e. four (see the arrow P1 in FIGS. 19A and 19B), so that the influence of the inter-port coupling is small and the inter-port isolation is not deteriorated.

As described above, according to the mobile communication base station antenna 60 in the sixth preferred embodiment, it is possible to provide the mobile communication base station antenna by which not only the main beam but also the side lobes are radiated with a good balance toward the antenna front direction, and the inter-port isolation is not deteriorated.

Therefore, it was confirmed that it is possible to provide the mobile communication base station antenna by which not only the main beam but also the side lobes are radiated with a good balance in the antenna front direction, and the inter-port isolation is not deteriorated, by setting a value of the total power supplied to the antenna elements in the first group G1 to be equal to a value of the total power supplied to the antenna elements in the third group G3.

Further, it was confirmed that it is possible to provide the mobile communication base station antenna by which not only the main beam but also the side lobes are radiated with a good balance in the antenna front direction, and the inter-port isolation is not deteriorated, by setting the sum of the total power supplied to the antenna elements in the first group G1 and the total power supplied to the antenna elements in the third group G3 to be equal to the total power supplied to the antenna elements in the second group G2.

Seventh Preferred Embodiment

Figure 21B:
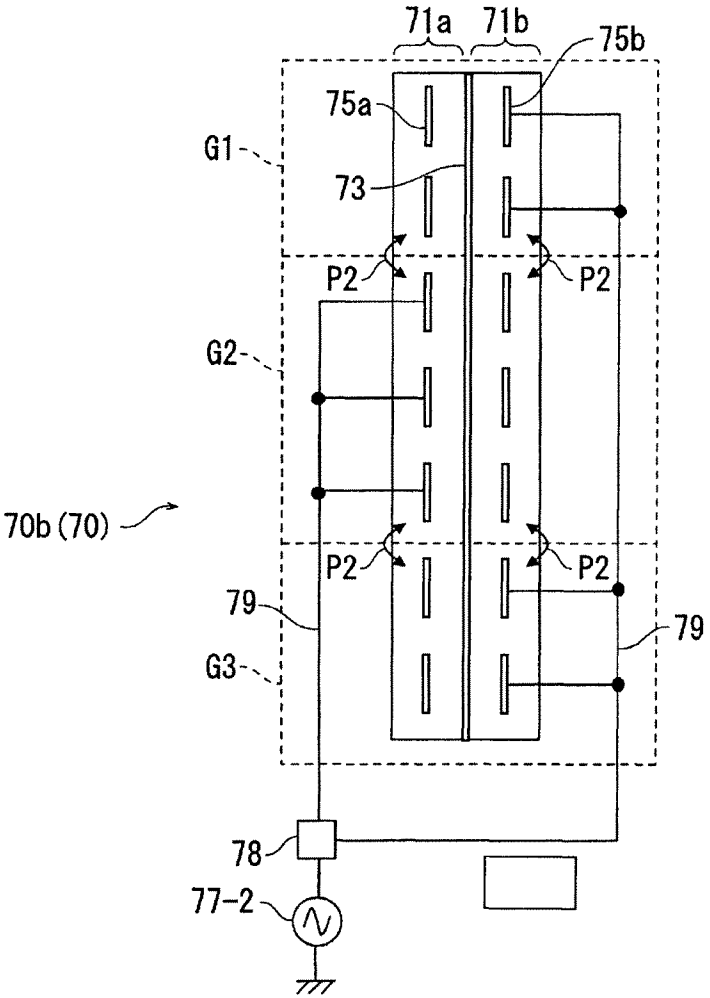
FIGS. 21A and 21B are schematic diagrams showing a mobile communication base station antenna 70 (70*a*, 70*b*) in the seventh preferred embodiment according to the invention.
Figure 21A:
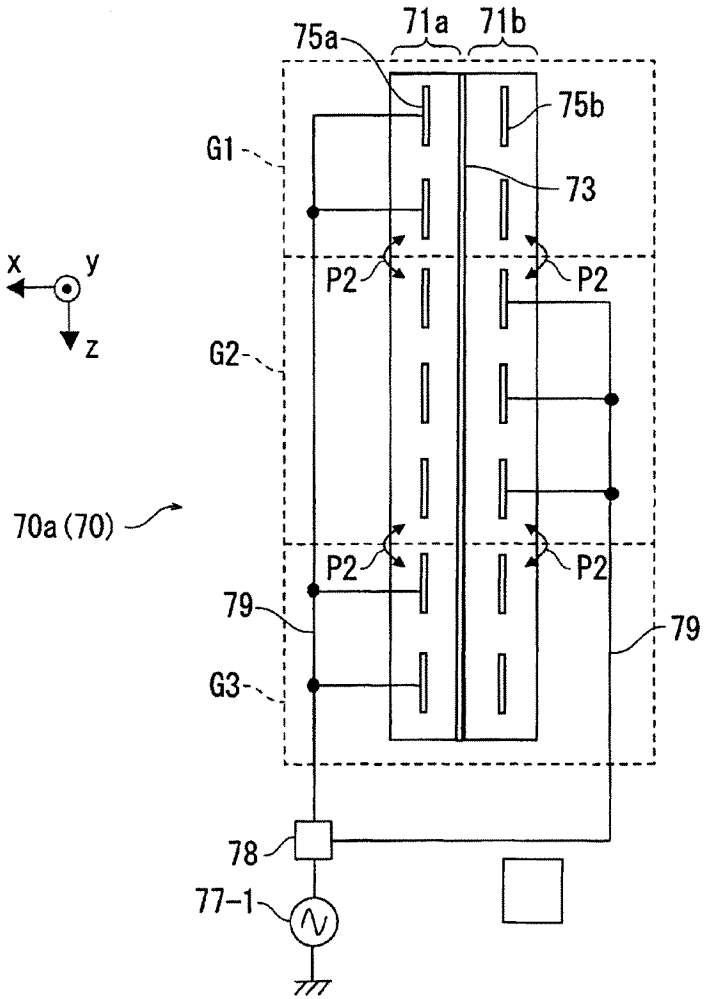
Figure 22:
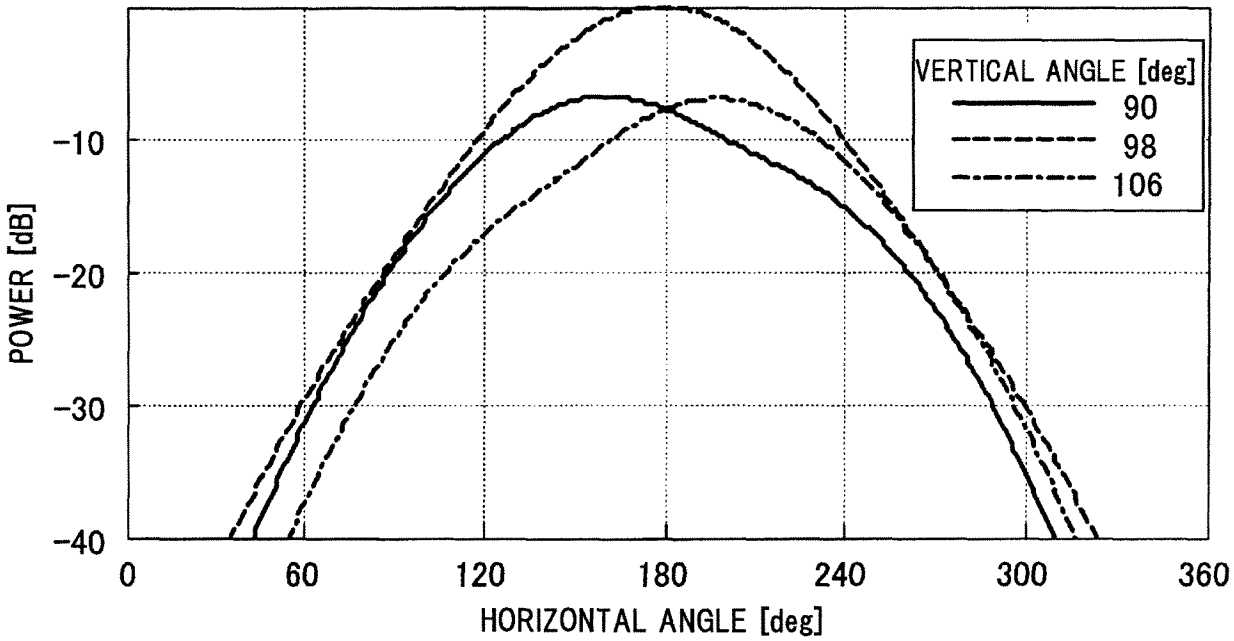
FIG. 22 is a diagram showing a horizontal plane directivity of the mobile communication base station antenna 70 in the seventh preferred embodiment according to the invention.

FIGS. 21A and 21B are schematic diagrams showing a mobile communication base station antenna 70 (70*a*, 70*b*) in the seventh preferred embodiment according to the invention.

The mobile communication base station antenna 70 comprises a first feeding port 77-1 and a second feeding port 77-2 for feeding the power to a first array antenna 71*a* and a second array antenna 71*b*.

Referring to FIG. 21A, the first feeding port 77-1 is connected to the first, second, sixth and seventh antenna elements 75*a* of the first array antenna 71*a* and the third, fourth and fifth antenna elements 75*b* of the second array antenna 71*b*.

On the other hand, referring to FIG. 21B, the second feeding port 77-2 is connected to the third, fourth and fifth antenna elements 75*a* of the first array antenna 71*a* and the first, second, sixth and seventh antenna elements 75*b* of the second array antenna 71*b*.

Referring to FIG. 21A, the first feeding port 77-1 is connected to the antenna elements 75*a* of the odd number groups (the first group G1 and the third group G3) of the first array antenna 71*a* and the antenna elements 75*b* of the even number group (the second group G2) of the second array antenna 71*b*.

On the other hand, referring to FIG. 21B, the second feeding port 77-2 is connected to the antenna elements 75*a* of the even number group (the second group G2) of the first array antenna 71*a* and the antenna elements 75*b* of the odd number groups (the first group G1 and the third group G3) of the second array antenna 71*b*.

In the seventh preferred embodiment, seven antenna elements 75 are disposed along the vertical direction, and two antenna elements 75, three antenna elements 75, and two antenna elements 75 in the order from the upper side to the lower side in the vertical direction are connected alternately to the two different feeding ports 77-1 and 77-2 (7-elements: 2-3-2 distribution).

In the seventh preferred embodiment, the number of the antenna elements 75 in each array antenna 71 is seven, and a power divider 78 is adjusted such that a ratio of the power distributed to the respective antenna elements 75 (from the upper side to the lower side in FIGS. 19A and 19B) is 5:20:25:25:15:5:5, when the total power is 100. The power distribution is similar to that in the sixth preferred embodiment.

Herein, the antenna elements 75 in each array antenna 71 is divided into three groups (i.e. the first, second and third groups G1, G2 and G3 in the order from the upper side to the lower side in FIGS. 21A and 21B).

A ratio of the sums of the power distributed to the respective groups G1, G2 and G3 is expressed as follows:

$$G1:G2:G3 = (5+20):(25+25+15):(5+5)$$
$$= 25:65:10$$
$$= 5:13:2.$$

Since the radiation power of each antenna element is proportional to the power supplied to each antenna element, a ratio of the radiation power of the respective groups G1, G2 and G3 is also expressed as:

G1:G2:G3=1:2:1.

A ratio of the sums of the power distributed to the first and second array antennas 71*a* and 71*b* is expressed as follows:

$$(\text{The first array antenna } 71a):(\text{The second array antenna } 71b) = (5+20+5+5):(25+25+15) = 35:65 = 7:13.$$

In this case, the number of combinations of one antenna element connected to one feeding port and its adjacent antenna element connected to the other feeding port (i.e. the number of pairs of the adjacent antenna elements connected to the different feeding ports 774 and 77-2 in FIGS. 21A and 21B) is four, referring to the combinations indicated by an arrow P2. Therefore, similarly to the sixth preferred embodiment, the inter-port isolation is not deteriorated.

FIG. 21 is a graph showing a horizontal plane directivity of the mobile communication base station antenna 70 in the seventh preferred embodiment according to the invention. According to the antenna element arrangement of the array antenna in the mobile communication base station antenna 70 shown in FIGS. 21A and 21B, horizontal plane directivities as shown in FIG. 20 are obtained. The maximum radiation direction is a direction of (horizontal angle $\phi$, vertical angle $\theta$)=(180°, 98°), and tilted with an angle of 8° toward the earth side from the horizontal direction. In the present preferred embodiment, the symmetry of the beam on the right and left sides is excellent in a horizontal plane (cut plane $\theta$=98°) including the maximum radiation direction, while the bilateral symmetry of the beam is bad in other horizontal planes (cut plane $\theta$=90° and 106°).

As described above, according to the mobile communication base station antenna 70 in the seventh preferred embodiment, it is possible to provide the mobile communication base station antenna, by which the bilateral symmetry of the main beam can be improved, the main beam can be radiated in the front direction with the good balance, and the inter-port isolation is not deteriorated, although the side lobes cannot be radiated in the front direction with the good balance.

Eighth Preferred Embodiment

Figure 23B:
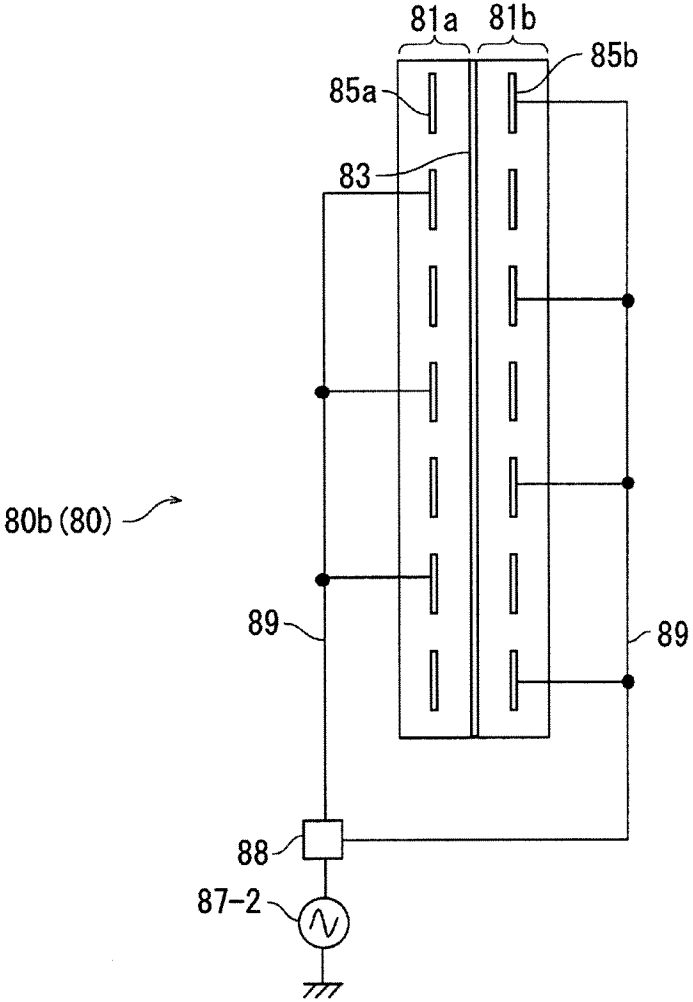
FIGS. 23A and 23B are schematic diagrams showing a mobile communication base station antenna 80 (80*a*, 80*b*) in the eighth preferred embodiment according to the invention.
Figure 23A:
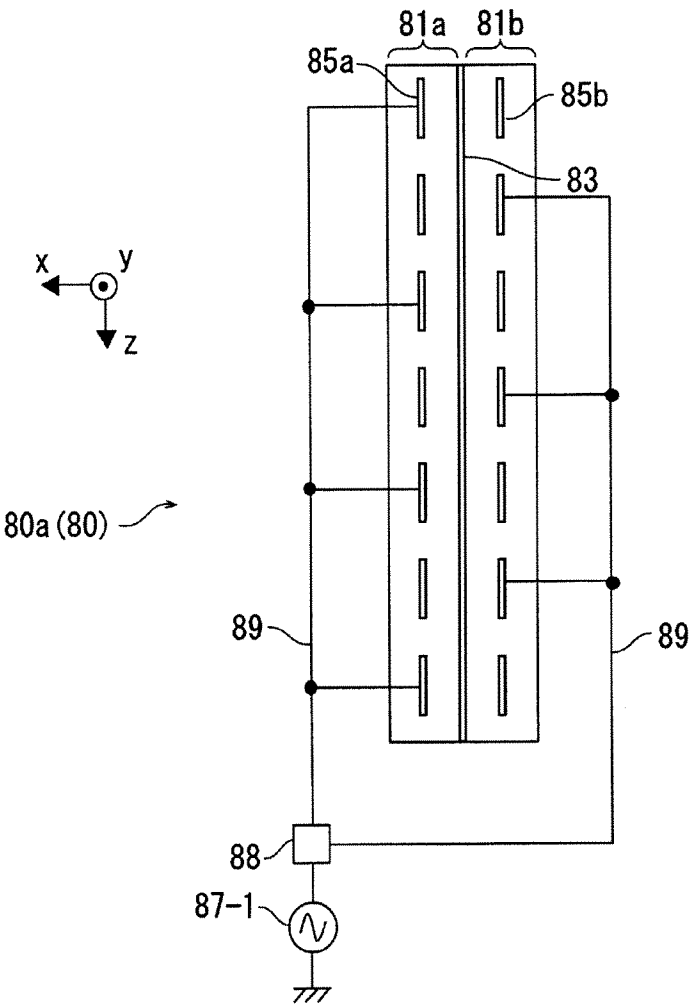

FIGS. 23A and 23B are schematic diagrams showing a mobile communication base station antenna 80 (80*a*, 80*b*) in the eighth preferred embodiment according to the invention.

The mobile communication base station antenna 80 comprises a first feeding port 88-1 and a second feeding port 88-2 for feeding the power to a first array antenna 81*a* and a second array antenna 81*b*.

Referring to FIG. 23A, the first feeding port 88-1 is connected to the first, third, fifth and seventh (the odd number) antenna elements 85*a* of the first array antenna 81*a* and the second, fourth and sixth (the even number) antenna elements 85*b* of the second array antenna 81*b*.

On the other hand, referring to FIG. 23B, the second feeding port 88-2 is connected to and the second, fourth and sixth (the even number) antenna elements 85*a* of the first array antenna 81*a* and the first, third, fifth and seventh (the odd number) antenna elements 85*b* of the second array antenna 81*b*.

In the eighth preferred embodiment, seven antenna elements 85 are disposed along the vertical direction, and the antenna elements 85 are connected one by one alternately in the order from the upper side to the lower side in the vertical direction to the two different feeding ports 88-1 and 88-2 (7-elements: Alternate distribution).

Figure 24:
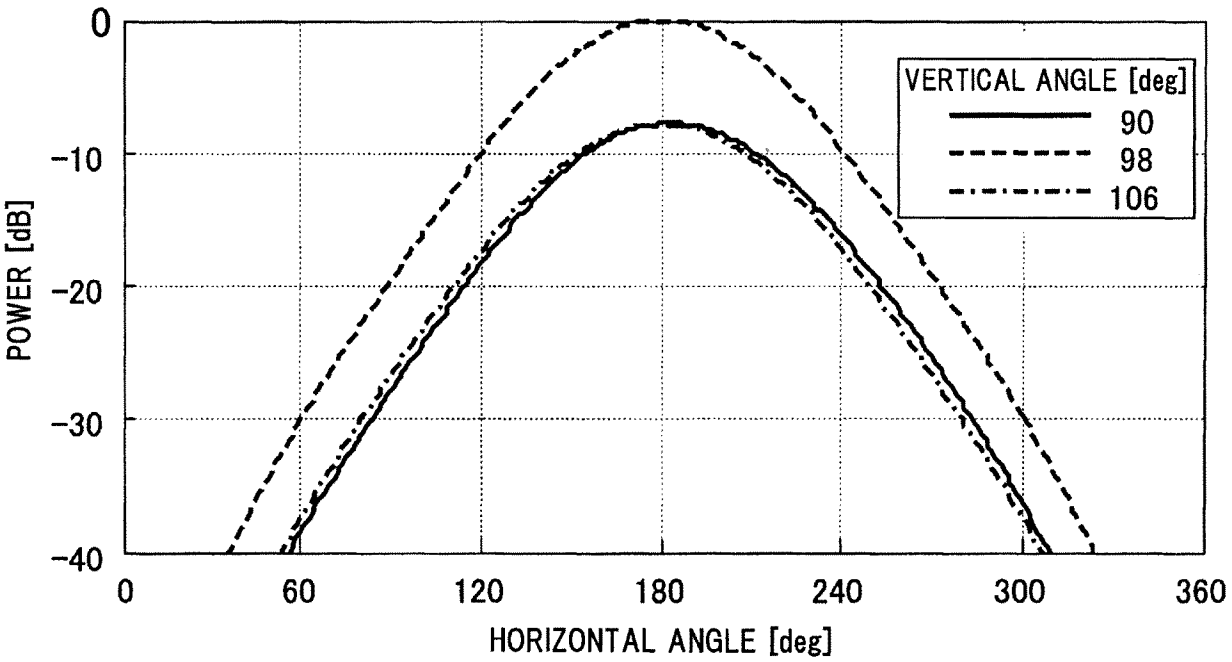
FIG. 24 is a diagram showing a horizontal plane directivity of the mobile communication base station antenna 80 in the eighth preferred embodiment according to the invention.

FIG. 24 is a graph showing a horizontal plane directivity of the mobile communication base station antenna 80 in the eighth preferred embodiment according to the invention. According to the antenna element arrangement of the array antenna in the mobile communication base station antenna 80 shown in FIGS. 23A and 23B, horizontal plane directivities as shown in FIG. 24 are obtained. The bilateral symmetry of the beam is excellent in a horizontal plane (cut plane $\theta$=98°) including the maximum radiation direction, and the bilateral symmetry of the beam is excellent also in other horizontal planes (cut plane $\theta$=90° and 106°).

Figure 25:
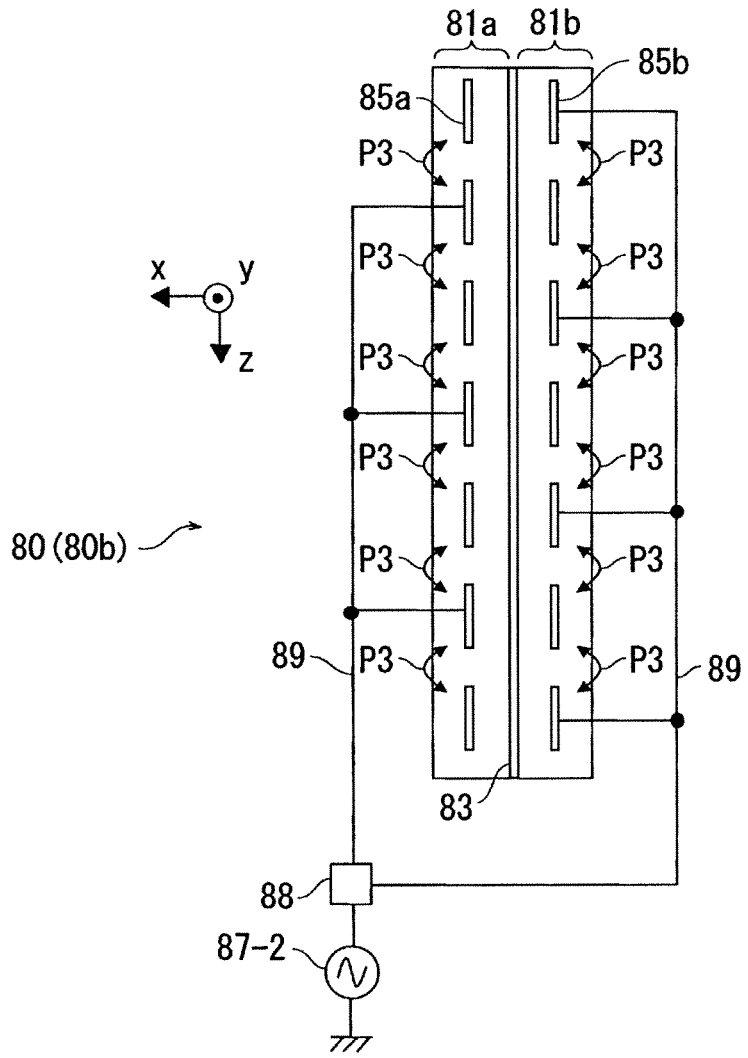
FIG. 25 is an explanatory diagram showing an inter-port coupling.

FIG. 25 is an explanatory diagram for explaining the inter-port coupling.

According to the antenna element arrangement of the array antenna in the mobile communication base station antenna 80 in the eighth preferred embodiment, the bilateral symmetry is excellent, while the inter-port isolation is slightly deteriorated. According to such a structure, as shown in FIG. 25, the number of combinations of one antenna element connected to one feeding port and its adjacent antenna element connected to the other feeding port (i.e. the number of pairs of the adjacent antenna elements connected to the different feeding ports 87-1 and 87-2 in FIGS. 23A and 23B) is large, i.e. twelve, referring to the combinations indicated by an arrow P3 in FIG. 25. Therefore, the inter-port coupling is increased, so that the inter-port isolation is slightly deteriorated.

As described above, according to the mobile communication base station antenna 80 in the eighth preferred embodiment, although the inter-port isolation is slightly deteriorated, the bilateral symmetry of the main beam and the side lobes can be improved, so that the beams can be radiated in the antenna front direction with the good balance.

The present invention is not limited to the preferred embodiments described above, and can be enforced with various modifications or replacements.

In the above preferred embodiments, two array antennas are disposed in the horizontal direction. However, three or more array antennas may be disposed in the horizontal direction. In the above preferred embodiments, the V-H polarized wave antenna pair is used as the antenna element pair. However, ±45 degree slant polarized wave antenna pair may be also used as the antenna element pair.

(Variation)

Figure 26B:
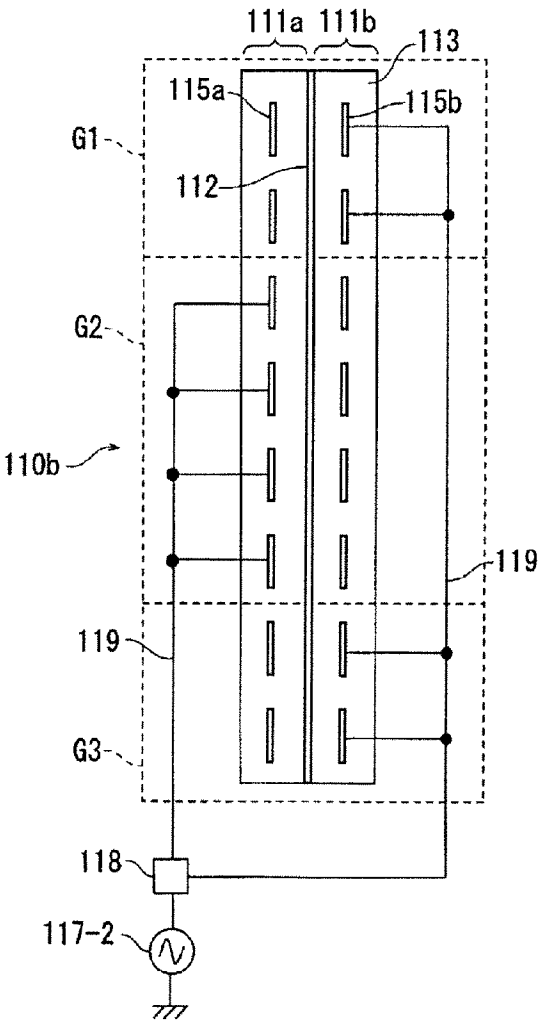
FIGS. 26A and 26B are schematic diagrams showing a mobile communication base station antenna 110 (110*a*, 110*b*) in a variation of the invention.
Figure 26A:
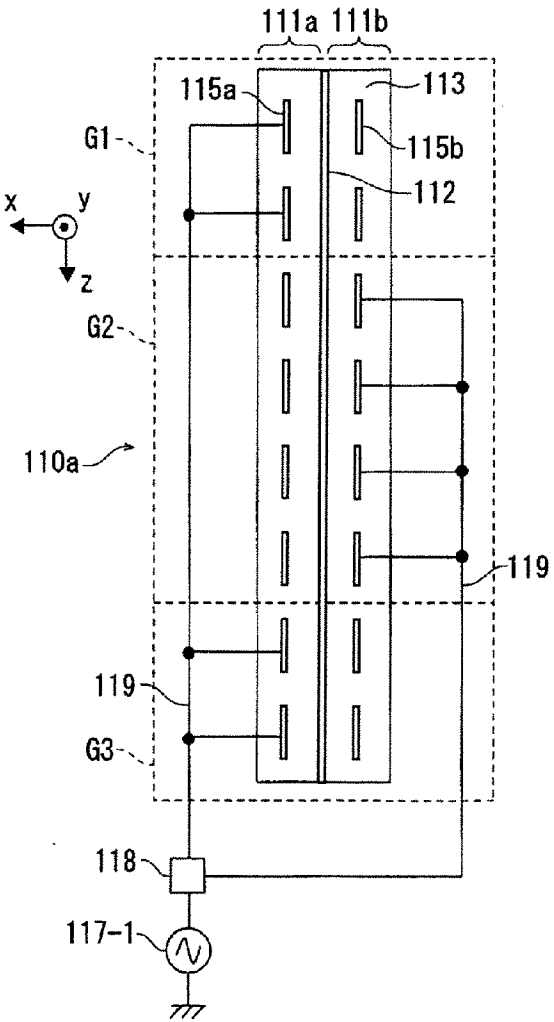

FIGS. 26A and 26B are schematic diagrams showing a mobile communication base station antenna 110 (110*a*, 110*b*) in a variation of the present invention The mobile communication base station antenna 110 is similar to that in the third preferred embodiment (referring to FIGS. 12A and 12B) having the antenna element arrangement of "10-element: 3-4-3 distribution", except that the antenna element arrangement of this variation is "8-elements: 2-4-2 distribution".

Referring to FIG. 26A, the first feeding port 117-1 is connected to the first, second, seventh, and eighth antenna elements 115*a* of the first array antenna 111*a* and the third, fourth, fifth and sixth antenna elements 115*b* of the second array antenna 111*b*.

On the other hand, referring to FIG. 12B, the second feeding port 117-2 is connected to the third, fourth, fifth and sixth antenna elements 115*a* of the first array antenna 111*a* and the first, second, seventh, and eighth antenna elements 115*b* of the second array antenna 111*b*.

Accordingly, the number of the antenna elements in the first group G1 is equal to the number of the antenna elements in the third group G3. In addition, the sum of the number of the antenna elements in the first Group G1 and the number of the antenna elements in the third group G3 is equal to the number of the antenna elements in the second group G2.

According to the aforementioned structure, it is possible to provide the mobile communication base station antenna, in which the antenna element arrangement with the good symmetry is realized and the bilateral balance of the horizontal plane directivity is outstanding.

The structures of the mobile communication base station antenna in the preferred embodiments as described above are preferred examples, and is enforceable with appropriate modifications.

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. A mobile communication base station antenna comprising:

at least two array antennas juxtaposed in a horizontal direction and comprising a first array antenna and a second array antenna, each of the first and second array antennas including antenna elements arranged in a vertical direction, each of the antenna elements having the same polarization characteristics;

a first feeding port and a second feeding port for feeding a power to the first and second array antennas;

wherein the first feeding port is connected to a part of the antenna elements in the first array antenna and a part of the antenna elements in the second array antenna, wherein the second feeding port is connected to a remaining part of the antenna elements in the first array antenna and a remaining part of the antenna elements in the second array antenna.

2. The mobile communication base station antenna according to claim 1, wherein the antenna elements are classified into a first group to an Nth group (N is an integer, and equal to or more than 3), each of which comprises at least two antenna elements, wherein the first feeding port is connected to the antenna elements in an odd number group of the first array antenna and the antenna elements in an even number group of the second array antenna, wherein the second feeding port is connected to the antenna elements in an even number group of the first array antenna and the antenna elements in an odd number group of the second array antenna.

3. The mobile communication base station antenna according to claim 2, wherein the N is 3 and the antenna elements are classified into the first group, a second group, and a third group, wherein the sum of the number of the antenna elements in the first group and the number of the antenna elements in the third group is equal to the number of the antenna elements in the second group.

4. The mobile communication base station antenna according to claim 2, wherein the N is 3 and the antenna elements are classified into the first group, a second group, and a third group, wherein the number of the antenna elements in the first group is equal to the number of the antenna elements in the third group.

5. The mobile communication base station antenna according to claim 2, wherein the N is 3 and the antenna elements are classified into the first group, a second group, and a third group, wherein a total power to be supplied to the antenna elements in the first group is equal to a total power to be supplied to the antenna elements in the third group.

6. The mobile communication base station antenna according to claim 2, wherein the N is 3 and the antenna elements are classified into the first group, a second group, and a third group, wherein a sum of a total power to be supplied to the antenna elements in the first group and a total power to be supplied to the antenna elements in the third group is equal to a total power to be supplied to the antenna elements in the second group.

7. The mobile communication base station antenna according to claim 1, further comprising:

a shield plate provided between the first and second array antennas for shielding an electromagnetic interference between the first and second array antennas.

8. The mobile communication base station antenna according to claim 1, further comprising:

a power divider connected to each of the first and second feeding ports, for dividing the power to the first and second array antennas, wherein powers divided into two power feeding systems are substantially equal to each other.

9. The mobile communication base station antenna according to claim 8, wherein the powers divided into the two power feeding systems are respectively supplied to the antenna elements that are equal in number in the first and second array antennas, respectively.

10. The mobile communication base station antenna according to claim 8, wherein each of the powers divided into the two power feeding systems is supplied to antenna elements having at least one continued portion in an antenna element arrangement in each of the first and second array antennas.

11. The mobile communication base station antenna according to claim 8, wherein the powers divided into the two power feeding systems are supplied to only one of two antenna elements juxtaposed in the horizontal direction to sandwich the shield plate.

12. The mobile communication base station antenna according to claim 8, wherein one of the powers divided into the two power feeding systems is supplied to antenna elements located at an upper portion in the vertical direction in the first array antenna, and an other of the powers divided into the two power feeding systems is supplied to antenna elements located at a lower portion in the vertical direction in the second array antenna.

13. The mobile communication base station antenna according to claim 7, wherein the shied plate comprises a plurality of shied plates provided in parallel with a predetermined interval between the two array antennas adjacent to each other.

14. The mobile communication base station antenna according to claim 7, wherein the shield plate comprises a metal or other conductor.

15. The mobile communication base station antenna according to claim 1, wherein each of the antenna elements comprises an antenna element pair comprising two antenna elements combined with each other, wherein the two antenna elements have polarization characteristics perpendicular to each other or crossed at a predetermined angle.

16. The mobile communication base station antenna according to claim 1, wherein the two array antennas are used for a Space Division Multiple Access communication.

* * * * *